US006704610B2

(12) United States Patent
West et al.

(10) Patent No.: US 6,704,610 B2
(45) Date of Patent: Mar. 9, 2004

(54) REPRODUCTION OF COLORED IMAGES ON ABSORBENT SUBSTRATES USING COLOR BLENDING TECHNIQUES

(75) Inventors: Kevin D. West, LaGrange, GA (US); Louis W. Adams, Jr., Inman, SC (US)

(73) Assignee: Milliken & Company, Spartanburg, SC (US)

( * ) Notice: Subject to any disclaimer, the term of this patent is extended or adjusted under 35 U.S.C. 154(b) by 122 days.

(21) Appl. No.: 09/934,937

(22) Filed: Aug. 22, 2001

(65) Prior Publication Data

US 2003/0060918 A1 Mar. 27, 2003

(51) Int. Cl.[7] ..... D06B 1/02; D06B 11/00; G06F 19/00

(52) U.S. Cl. ..... 700/133; 8/149; 68/205 R; 239/69

(58) Field of Search ..... 700/133, 130, 700/131, 132, 135; 8/149; 68/205 R; 239/69; 707/104.1; 358/1.9, 518

(56) References Cited

U.S. PATENT DOCUMENTS

| | | | | |
|---|---|---|---|---|
| 5,398,297 A | | 3/1995 | Clark et al. | 358/298 |
| 5,933,578 A | * | 8/1999 | Van de Capelle et al. | 358/1.9 |
| 6,233,496 B1 | | 5/2001 | Ippitsu | 700/133 |
| 6,406,121 B1 | * | 6/2002 | Benjamin et al. | 347/2 X |
| 6,483,607 B1 | * | 11/2002 | Van de Capelle | 358/1.9 |

* cited by examiner

*Primary Examiner*—Peter Nerbun
(74) *Attorney, Agent, or Firm*—Terry T. Moyer; George M. Fisher

(57) ABSTRACT

A process by which dithering techniques may be used to reproduce a desired multi-colored dyed pattern on a substrate using precisely delivered quantities of liquid colorants that are available in only a relatively few colors. In one embodiment, the process is one in which a designer, working with a conventional computer-aided design system, can be provided with an image that accurately predicts the appearance of individual colorants, or a specific combination of colorants that are physically blended on the substrate within specified pixels, as those colorants would appear on the substrate selected by the designer. In other embodiments incorporating the process disclosed herein, specific actuation instructions for a specific dye injection machine capable of patterning a moving textile substrate may be generated.

19 Claims, 19 Drawing Sheets

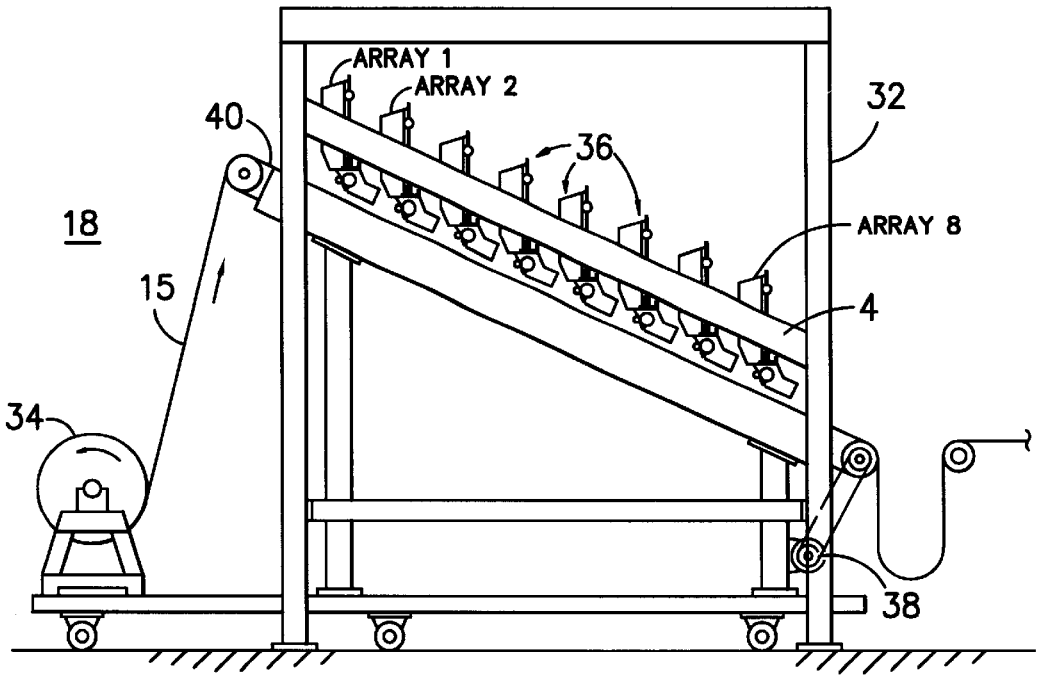
FIG. –1–

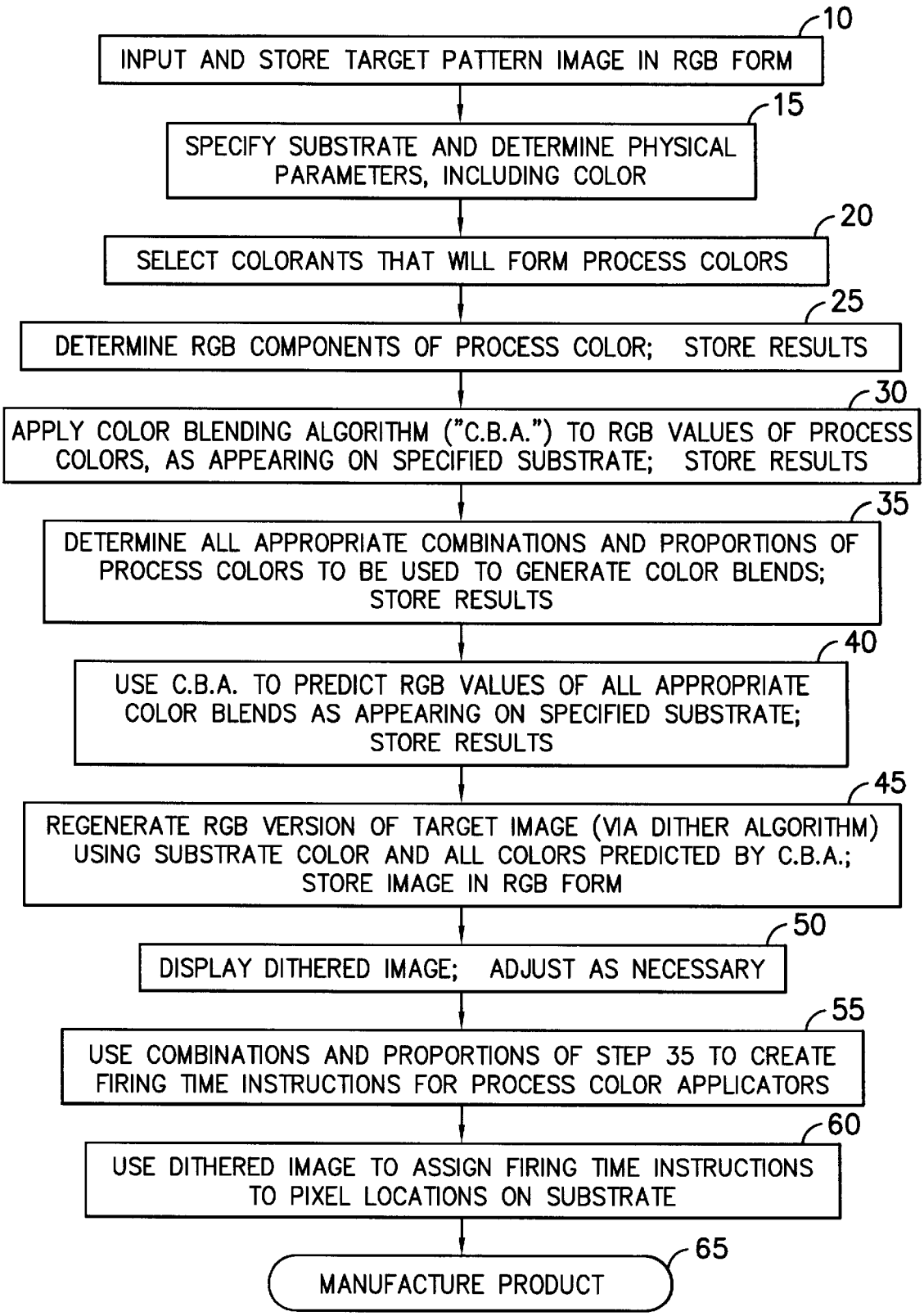
*FIG. –2–*

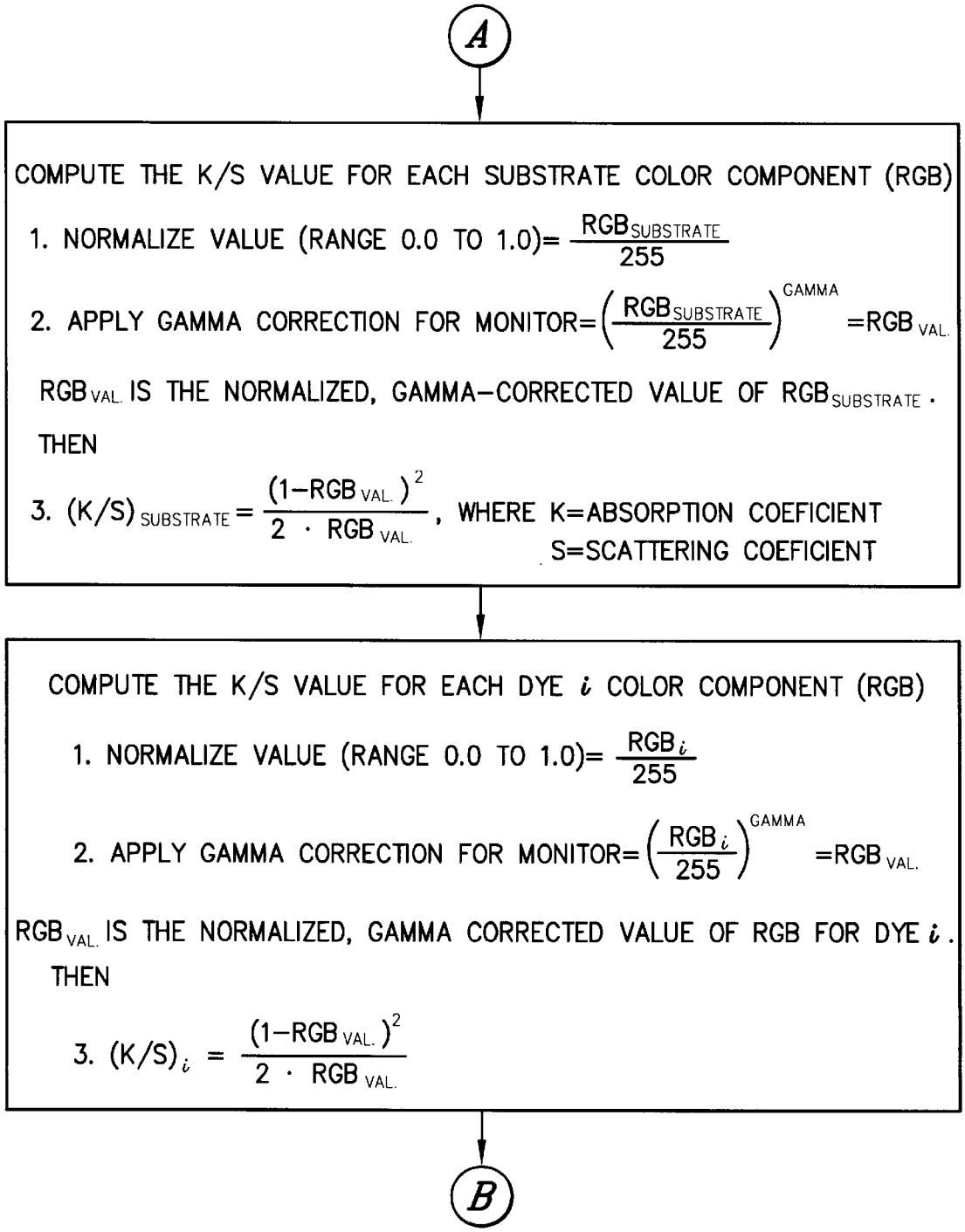
*FIG. —3B—*

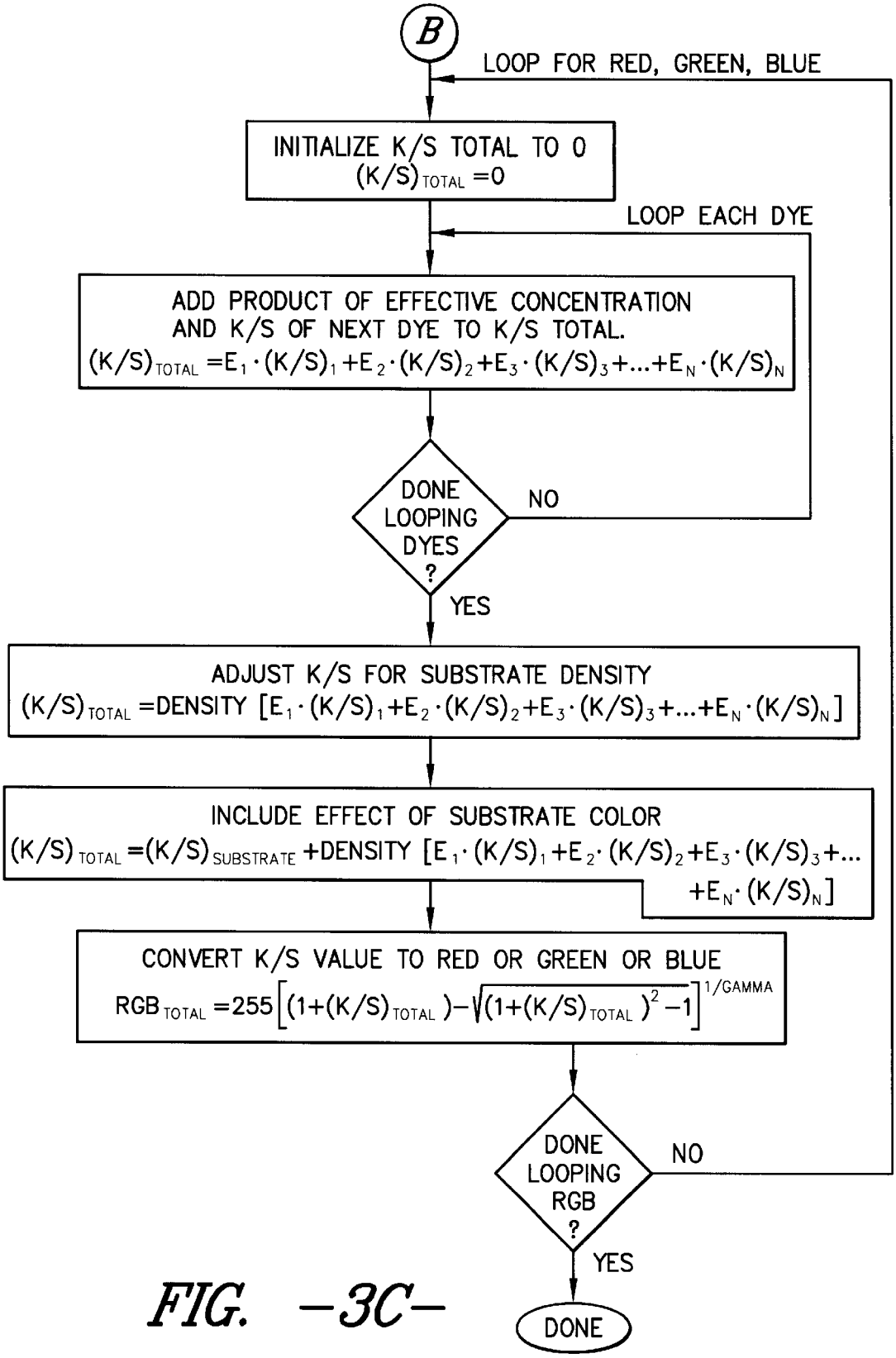
FIG. —3C—

PRIOR ART

*FIG. —6—*

BASE WXYZ

| BAR | FT |
|---|---|
| 1 | 10 |
| 2 | 10 |
| 3 | 20 |
| 4 | 15 |

FIG. –10A–

MACHINE CONFIG.

| COLOR | BAR |
|---|---|
| RED | 1 |
| BLUE | 2 |
| GREEN | 3 |
| YELLOW | 4 |

FIG. –10B–

SKU ABC

| CODE | COLOR |
|---|---|
| A | RED |
| B | BLUE |

FIG. –10C–

BASE WXYZ

| BAR | FT |
|---|---|
| 1 | 10 |
| 2 | 10 |
| 3 | 20 |
| 4 | 15 |

FIG. –11A–

MACHINE CONFIG.

| COLOR | BAR |
|---|---|
| RED | 1 |
| BLUE | 2 |
| GREEN | 3 |
| YELLOW | 4 |

FIG. –11B–

SKU ADE

| CODE | COLOR |
|---|---|
| A | 50% RED, 50% BLUE |
| C | GREEN |

FIG. –11C–

LUT'S

| CODES | 1 | 2 | 3 | 4 |
|---|---|---|---|---|
| A | 10MS | 0 | 0 | 0 |
| B | 0 | 10MS | 0 | 0 |
| | | | | |

FIG. –10D–

LUT'S

| | 1 | 2 | 3 | 4 |
|---|---|---|---|---|
| A | 5MS | 5MS | 0 | 0 |
| C | 0 | 0 | 20MS | 0 |
| | | | | |

FIG. –11D–

LUT'S

| | 1 | 2 | 3 | 4 |
|---|---|---|---|---|
| A | 0 | 0 | 20MS | 0 |
| B | 0 | 10MS | 0 | 0 |
| C | 5MS | 2.5MS | 0 | 3.75MS |
| | | | | |

FIG. –11E–

LUT'S

| | 1 | 2 | 3 | 4 | 5 |
|---|---|---|---|---|---|
| A | 0 | 0 | 0 | 0 | 10MS |
| B | 0 | 10MS | 0 | 0 | 0 |
| | | | | | |

FIG. –11F–

REPRODUCTION OF COLORED IMAGES ON ABSORBENT SUBSTRATES USING COLOR BLENDING TECHNIQUES

This disclosure relates to a computer-assisted process in which a designer may predict the appearance of a desired multi-colored pattern on a substrate that is generated using precisely delivered quantities of liquid colorants that are available in only a relatively few colors. Specifically, this disclosure relates to a process by which a designer, working with a computer-aided design system, can reproduce an arbitrarily colored image using a relatively small palette of colors through the use of dithering and can be provided with an image that accurately predicts the appearance of that image on a specific substrate. In other embodiments incorporating the process disclosed herein, specific actuation instructions for a specific dye injection machine capable of patterning a moving textile substrate may be generated.

BACKGROUND

As is well known in the field of computer graphics, images displayed on a computer cathode ray tube ("CRT") or liquid crystal display ("LCD") or similar device typically are composed of a set of hundreds of thousands of individually addressable pixels or picture elements, each of which may carry a color shade that is selected from, say, 256 shades in a system in which the color is specified in an eight-bit digital system, to over 16 million different shades in a 24-bit system. These shades are "constructed" by appropriate combinations of three "primary" color components—red, green, and blue—of the color space traditionally associated with such display devices. As a means of expanding the total number of colors that can be constructed from a given set of available "primary" colors, various techniques collectively known as "dithering" were developed to increase the apparent color range of the displayed image, although these techniques are generally not needed for systems using 16 or more bits.

In the field of computer graphics, dithering is a term that is used to refer to a class of computer software algorithms that simulate, for display or patterning purposes, a greater number of apparent colors than those actually present on the display or substrate. These algorithms use techniques that are somewhat similar to the halftone methods that are employed in the printing industry. In such methods, small areas or "dots" of the process colors (e.g., the colors of the different individual contrasting colorants or dyes available for use) are arranged in close proximity into groups. These "dots" are directly analogous to the "pixel" concept in computer graphics, and corresponding to the smallest area on the substrate in which a quantity of colorant can be precisely and reliably placed.

When viewed by the unaided eye at a distance such that the eye cannot resolve the individual component dots, the dot grouping takes on a color that is an apparent blend of the colors of the individual dots, and can cause the eye to perceive a color that is different from that of any of the individual dots comprising the dot grouping. In halftone and dithering methods, the size as well as the color of the individual dots may be varied to assist in achieving the desired colors. The techniques described herein, however, are applicable whether or not the dot size (or the total quantity of ink per pixel) is varied.

Consistent with the above, as used herein the term "pixel" shall refer to the smallest area or location in a pattern or on a substrate that can be individually addressable or assignable with a given color. Alternatively, if clear from the context, the term "pixel" shall refer to the smallest pattern element necessary to define the line elements of the pattern to a predetermined level of detail, analogous to the pixel counts in imaging device resolution specifications (e.g., 1280×1024).

The techniques described herein are applicable to the patterning of a variety of substrates, but will be described in terms of an absorbent substrate such as a textile substrate. Dye application techniques that may be considered include, but are not limited to, silk screen printing, offset printing, and various methods in which a stream of dye is directed onto the substrate surface. While the techniques described herein can be used in conjunction with a variety of printing systems, they are particularly well suited to systems in which the dyed image is formed by the precise delivery of an individually specified aliquot of liquid dye to a predetermined location (i.e., the pixel to be colored) on the substrate surface. One such technique for use in patterning textile substrates is described, for example, in commonly-assigned U.S. Pat. Nos. 4,033,154; 4,116,626; 4,545,086; 4,984,169; and 5,195,043, all of which are hereby incorporated by reference herein. It should be understood that other textile substrates, such as decorative or upholstery fabrics, or other absorbent substrates, may also be used.

Machines embodying the patterning techniques described in the above-listed patent documents are particularly well-adapted for patterning textile substrates. Such machines consist fundamentally of a plurality of fixed arrays of individually controllable dye jets, each array being supplied by a respective liquid dye supply system carrying liquid dye of a specified color (known as a "process" color). Because the jets on each array are capable only of dispensing the liquid dye supplied to that array, the maximum number of different colors that can be directly applied to the substrate by the machine (i.e., the maximum number of process colors) equals the number of arrays. As will be explained below, the number of colors generated on the substrate may be much greater through in situ blending techniques, and the number of colors perceived to be on the substrate might be much greater still, through the use of the dithering techniques disclosed herein.

The arrays are positioned in parallel relationship, spanning the width of the substrate to be patterned (i.e., generally perpendicular to the direction of web travel). While the substrate moves along the path, it passes under each of the arrays in turn and receives, at predetermined locations on the substrate surface (i.e., at the pixel locations specified by the pattern data), a carefully metered quantity of dye from one or more of the dye jets spaced along the array. The control system associated with the machine provides for the capability of delivering a precise quantity of dye (which quantity may be varied in accordance with the desired pattern) at each specified location on the substrate as the substrate moves under each respective array, in accordance with electronically defined pattern information. An important feature of this system is that a given pixel on the substrate may receive liquid dye from several different arrays, thereby providing for the in situ blending of different dyes on the substrate within the same pixel, resulting in the generation of colors visually distinct from the inherent colors of the individually applied liquid dyes. It should be noted that the sequential nature of this process, with the second colorant being applied after—and therefore on top of—the first colorant, greatly complicates the task of predicting with accuracy the color of the resulting blend of colorants. Making such predictions is essential if the blended color is to be used with confidence in a dithering algorithm for the purpose of reproducing pattern colors accurately.

It should be understood that the techniques described herein are not limited to the specific patterning systems described above. For example, an arrangement of liquid colorant (e.g., dye) applicators, perhaps grouped in terms of color to be applied, may be traversed across the path of a sequentially indexed substrate while dispensing measured quantities of dye. Although such arrangement is distinct from the fixed array systems discussed above, it is believed that the teachings herein are fully applicable to and adaptable for use with such systems, e.g., screen printing systems, so long as absorbent substrates are used.

It should be understood that, as used hereinbelow, the term "concentration" is intended to refer to the relative volumetric absorption of liquid colorant by the substrate, and not the relative dilution or chromophore content of the liquid colorant—i.e., a colorant applied to a pixel at a 50% concentration means that pixel has only been saturated to one half its capacity to absorb colorant, and additional colorant(s) may be applied without exceeding the absorptive capacity of the substrate at that location.

To facilitate the descriptions that follow, four different color-related terms will be used. The term "target color" will refer to the desired color of the pixel as it appears in the design that is to be reproduced on the substrate. The term "process color" will refer to the inherent color of the individual, unblended dye or other colorant that is supplied to each of the individual dye jets comprising a given array, and that may be directly applied in pixel-by-pixel fashion to the substrate. Note that the same process color may have a different visual appearance on different substrates, due to inherent substrate color, substrate texture, etc.

The term "blended color" shall be used where quantities of two or more colorants occupy the same pixel-sized location on a substrate; the term "blended color" refers to the color of the physical combination or in situ blending of those two or more colorants, as viewed at the individual pixel level. In a preferred embodiment, the blended color will incorporate and compensate for the inherent color, if any, of the substrate prior to the application of any colorant, as well as for the construction of the substrate; accordingly, in that embodiment, the term "blended color" refers to the mixture of the colorants as that mixture would appear on the substrate at that pixel-sized location.

The term "perceived color" shall refer to the color of a small area of a substrate as viewed from a distance such that individual pixels comprising or adjacent to the small area are not readily resolvable by the eye, and the colors of the individual pixels are visually integrated by the eye of the observer to form a visual blend. An example of perceived color is the color of an area of a pattern comprised of an assortment of different colored pixels (e.g., a uniform mixture of equal numbers of blue and yellow pixels in the form of a random arrangement) which, when viewed at a distance, appear to have a color (e.g., green) that is different from any of the individual pixels included in that pattern area.

Because of the generally absorbent nature of textile substrates, the creation of various colors on such substrates with liquid dyes, particularly using the dye injection method described above, may involve one or several mechanisms or techniques.

The most straightforward color formation technique shall be referred to as "solid shade", which involves the application of a single color (i.e., a single liquid colorant) to a pattern area. Typically, the concentration (in terms of substrate volumetric absorption capacity) is 100%, but may be lower if it is desired to create a lighter color or restrict the migration of dye outside the pixel area.

As discussed above, "Intrapixel Blend" colors are formed by the deliberate application of two different colors (i.e., two different colorants) to the same "check" or pixel, thereby causing in situ blending of the two colorants within that pixel. Typically, the concentration (in terms of substrate volumetric absorption capacity) of the applied colorants will sum to no more than 100% to assure normal substrate dye saturation. For example, a blue and a yellow colorant may each be applied to the same pixel at a 50% concentration.

A third basic process for forming color within a pattern area involves dithering, wherein individual members of a group of pixels are colored, using one or a combination of process colorants, in a way that, when viewed at a distance, expresses the desired color. For example, gray may be constructed from black and white print dots, with lighter shades having a higher percentage of white dots, and darker shades a higher percentage of black dots. Where necessary for clarity, this discussion will distinguish such dithering techniques, which are sometimes associated only with pattern areas in which the color is non-uniform, from halftone techniques, useful in pattern areas in which a continuous or uniform color is desired, in which a group of pixels that collectively express the proper color are tiled, as a repeating unit, into the appropriate areas. Unless this distinction is made clear, either by statement or by context, the terms halftoning and dithering will have similar meanings.

SUMMARY OF THE INVENTION

In a preferred embodiment, the techniques described herein involve the use of in situ blending of process colors on the substrate, as produced by the sequential application of two (or more) colorants of different colors to the same pixel on the substrate, using the intrapixel blending technique. By use of this technique, it is possible to produce, for use in a dithering palette, pixels with colors that would be unavailable in the absence of such in situ blending. By use of such blended colors, it is possible to produce a dithered image that provides for a much better perceived representation of the target colors in the pattern to be reproduced. Use of such dithered images in conjunction with the dye jet patterning system disclosed herein is believed to produce patterned substrates having exceptional visual impact.

In a preferred embodiment, a set of liquid colorants is selected, each colorant having a different color. These colors become the "process" colors. Determination of the process colors to be used can be quite important to the accuracy with which the target colors can be reproduced, even with the use of dithering techniques. Historically, the decision as to what process colors should be selected usually involved one of the following: (1) identification (perhaps computer assisted) of the most common colors contained in the target pattern, and using those colors, (2) dividing the selected color space into arbitrary but equal increments and selecting colors that represent such equal increments of the color space (e.g., dividing the RGB color space, represented by an "RGB Color Cube" along each of the respective R, G, and B axes, and defining the process colors as the RGB values at the intersections of the increment boundaries), (3) using a set of colors associated with a readily available set of colorants (or set of colorants that are otherwise convenient or desirable to work with, without particular regard to their intrinsic color), (4) using a set of colors because their intrinsic color is aesthetically pleasing, or (5) some combination or variation of the preceding four methods.

The introduction of the concept of blended colors presents an important additional consideration with respect to this choice of process colors—specifically, consideration of the resulting range of blends that is theoretically possible with that combination of process colors and how best to maximize that range.

Following the appropriate choice of process colors, predetermined combinations of the corresponding colorants are then chosen (e.g., where two different colorants are used, progressive, incremental combinations of, say, 10%/90%, 20%/80%, 30%/70%, etc.), and a mathematical or heuristic "color blending" algorithm may be used to calculate the blended color resulting from each such predetermined combination. Among methods that may be used to predict the resulting blended colors are operator experience or graphical design software such as Adobe Photoshop®, published by Adobe Systems Incorporated, San Jose, Calif. However, none of these systems is capable of satisfactorily and reliably predicting the color generated on a given substrate by the physical placement and blending of several liquid colorants, while accounting for the visual effect of the substrate's physical characteristics such as its absorbent characteristics. It is possible to generate samples on more-or-less a trial and error basis, but that approach generally is neither efficient nor inexpensive. Accordingly, none of these systems is capable of accurately modeling and predicting the visual appearance of physically blended colors on the surface of the selected substrate.

A preferred approach to predicting the visual appearance of various colorant blends on specific substrates involves use of the color blending algorithm described herein. As will be described in greater detail below, this algorithm may be used to generate a color on a computer monitor that closely simulates each blended color, as it would appear on the substrate. This information can also be made available to a conventional dithering algorithm. Because of the wide range of visually accurate colors available to the dithering algorithm by the color blending algorithm (i.e., all process colors and all blended colors, as they will appear on the chosen substrate), it has been found that the selected dithering algorithm is likely to be much more effective in generating a dithered image that effectively matches the target colors than other, prior art systems.

Using the terminology defined above, it is an object of this invention to generate, using a limited number of predetermined process colors and colorants, a perceived color on the selected substrate that most closely matches the target color for each target color in the pattern to be reproduced.

BRIEF DESCRIPTION OF THE DRAWINGS

Details of the dithering process disclosed herein, as well as variations that have been found to enhance this process under some conditions, will be explained with the aid of the accompanying Figures, in which FIG. 1 schematically depicts one example of a prior art computer-controlled dye injection patterning device that is suitable for patterning textile substrates in accordance with the teachings herein.

FIG. 2 shows a flow diagram of one embodiment of the patterning process described herein.

FIGS. 3A through 3C depict a flow diagram of the color blending algorithm, referred to in FIG. 2, for predicting the observed color resulting from the application of one or more colorants to a specified substrate pixel or location.

FIGS. 10A–10D illustrate a firing time table, machine color table, pattern color table and look-up tables, respectively, for a prior art method by which the patterns developed herein may be implemented by a patterning device.

FIGS. 11A–11F illustrate further examples of prior art look-up tables to be used in connection with the patterns developed according to the teachings herein.

FIG. 13A depicts a memory state at a time T1;

FIG. 13B depicts a memory state at time T2, exactly one hundred pattern lines later;

DETAILED DESCRIPTION

Figure 3A:
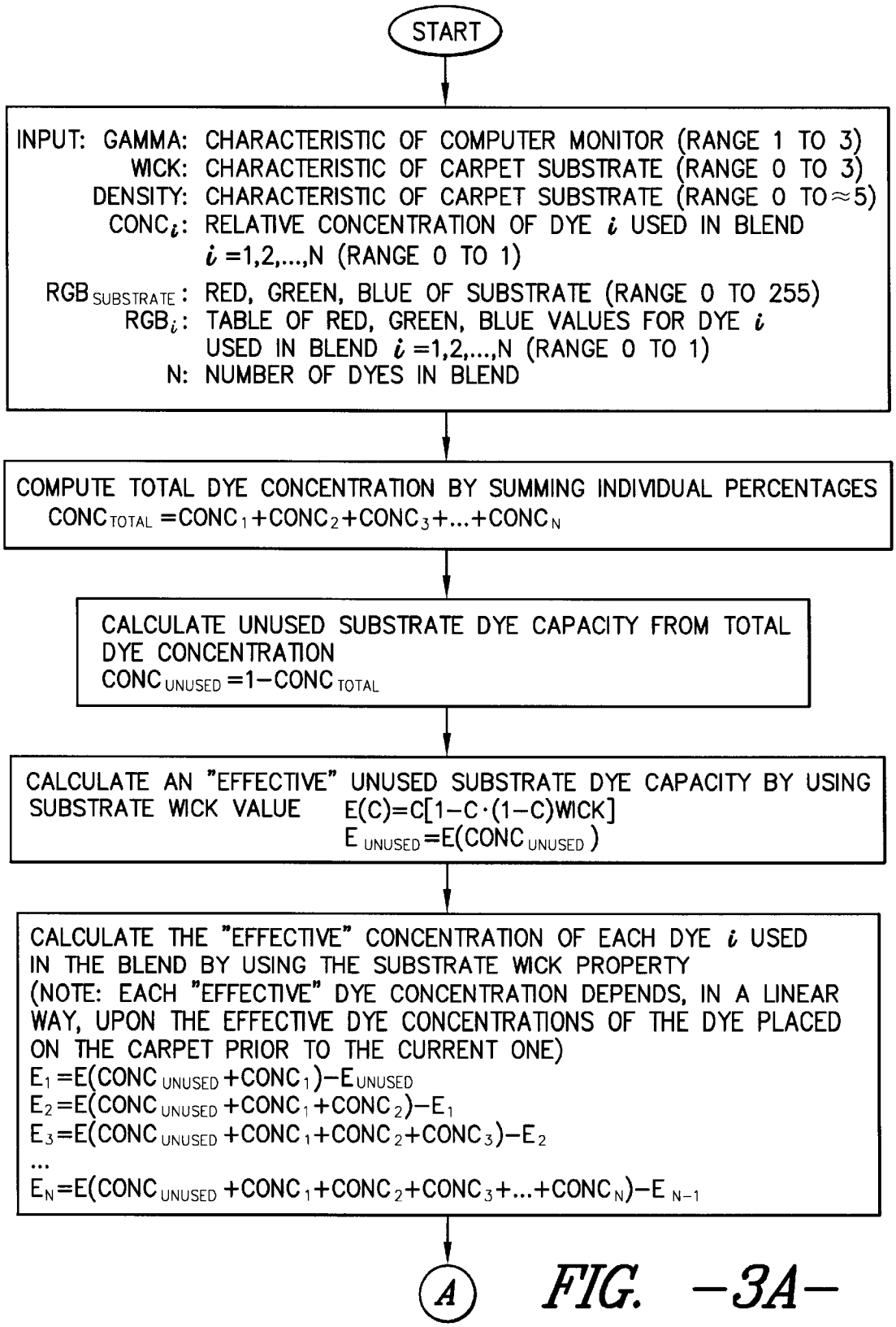

While dithering techniques can be accomplished by hand, i.e., using trial-and-error techniques and visually checking the results, most dithering techniques used in computer applications (including the computer-controlled dyeing techniques described below) are mathematically based. In the technique used herein, each pixel or picture element of the design to be reproduced is individually considered, in order, by the computer, in an adaptive dithering process. The desired color of the pixel (i.e., the "target" color) is compared mathematically to the available process colors and, in liquid colorant systems, all specified blended colors that can be reliably constructed from those process colors. It has been found convenient to use the RGB color space in making such mathematical operations, primarily because of the ubiquitous role played by computer display devices (which express color in terms of RGB values) in most pattern design systems. However, other notations or systems, such as L*a*b or Yxy, may also be used, with appropriate modifications to the specific teachings herein. The process color or blended color from the available color palette that is closest to the target color is selected and assigned to that pixel.

Many dithering algorithms use adaptive dithering, in which the difference or "error" between this "selected" color (selected from the available color palette) and the target color is mathematically quantified, again by use of an appropriate color measurement system, and is "distributed" among neighboring pixels in accordance with any of a variety of conventional dithering algorithms that have been developed for this purpose, with varying degrees of effectiveness (depending upon the algorithm chosen and the appropriateness of that choice with respect to the pattern to be visually reproduced). Because the error becomes incorporated into the neighboring pixels, a "mini-collage" or "mini-mosaic" of color is created that, when viewed from a distance, has a perceived color that more nearly matches the target color than any of the individual process or blended colors used to color any single pixel.

It is believed that any of several different dithering algorithms, including adaptive algorithms, may be used to yield satisfactory results. For example, it is believed that algorithms based upon the work of Thiadmer Riemersma, as described in "A Balanced Dithering Technique," appearing in the December, 1998 issue of C/C++ User's Journal are generally suited to this application. The Riemersma dithering algorithm is one that, because it can reduce a color image using any available color palette and because it restricts the influence of a dithered pixel to a small area around it, may be thought of as combining advantages of ordered dithering schemes (localized influence) and error diffusion dithering schemes. However, the Riemersma algorithm may tend to produce results that are somewhat grainy in appearance. Alternatively, and frequently preferably, a popular error diffusion dithering algorithm known in the prior art as Floyd-Steinberg dithering and described, for example, in the an article appearing at Page 253 of the Mar. 28, 1995 issue of "PC Magazine" may be found to produce smoother results. Where use of Floyd-Steinberg dithering produces excessive pixelation, Riemersma dithering may be preferred. It is believed that other dithering algorithms known in the prior art, such as those available in Adobe Photoshop® or similar graphics software, may also yield satisfactory results.

The teachings herein provide a means for accommodating the effects on perceived color of various physical characteristics of the substrate. One such characteristic is the inherent color of the substrate prior to patterning. This allows for the dithering algorithm to use the color of the substrate as an additional color in the available color palette. Perhaps more importantly, this provides for an embodiment in which both the process colors and the in situ-blended colors, which collectively comprise the available color palette, may be predicted as they would appear on the inherently colored substrate. Furthermore, the use of the color blending algorithm disclosed herein also provides for yet another, preferred embodiment in which the colors comprising the available color palette may be adjusted to accommodate the effects of various other physical properties that are relevant to the prediction of color when a liquid colorant is applied to an absorbent substrate. The color blending algorithm introduces the effects of a variety of such physical properties by the use of two user-specified parameters: (1) WICK (a user-defined parameter intended to accommodate a variety of related physical characteristics such as viscosity of colorant solutions, capillary structure of the substrate, yarn or pile lay, twist, and compaction, and the surface tension of the colorant solution on the substrate that affects the degree of colorant mixing) and (2) DENSITY (another user-defined parameter intended to accommodate a variety of related physical characteristics such as yarn or pile lay, twist, and compaction, the shape of the yarn fiber cross section, and the index of refraction and de-lusterant content of the materials comprising the substrate that affects the saturation or chroma of the print color).

As an initial step, it is necessary to define the RGB values of the target color or colors that make up the pattern to be reproduced. One method, involving visual matching of colors, can use any of a number of commercially available graphics editing software packages, for example, Adobe Photoshop®, published by Adobe Systems Incorporated, San Jose, Calif. This may be achieved by separately selecting values for each of the Red, Green, and Blue components on a computer display device and visually comparing the displayed color with the target color, as from a swatch, photograph, or artistic rendering, until a visual match is achieved. Of course, the color may also be input to the system by means of a scanner or similar technology. By making adjustments to the individual RGB values, various "candidate" target colors can be generated and assessed. The candidate target color that, when viewed on a computer monitor, appears closest in color to the "true" target color (e.g., the observed color of the swatch) may be used as the target color for purposes of the techniques disclosed herein. When the desired target color has been constructed and selected, its RGB values are saved, to be used later.

A similar procedure, again using visual matching of colors as they appear on a computer display device, may be used to determine or predict the RGB values of all the colors comprising the available color palette from which the dithered image will be constructed. This technique may yield entirely satisfactory results under certain conditions, particularly if the colors to be used in the dithering palette are in the form of single dyes or unblended colorants. However, it is generally believed that, where it is desired to derive palette colors from combinations or blends of two or more colorants, perhaps in unequal concentrations, the relative simplicity of this concept is offset by the complexity of predicting, with any acceptable degree of accuracy, the color of such blends as they would appear on a specific substrate.

Alternatively and preferably, the Color Blending Algorithm discussed above and described in more detail below may be used. In using this technique, the colorant combinations are predicted by beginning with RGB values provided by the designer based upon visual matches to samples for the process colors (and the inherent color, if any, of the substrate). Alternatively, a color scanner, spectrophotometer, or other color-measuring device can be used, perhaps with even better results. Then, using RGB values for the process colors in the Color Blending Algorithm described below, RGB values for all reliable blends of such process colors, as they would appear on the substrate of interest (i.e., with compensations for substrate color as well as the various physical characteristics that are collectively parameterized through the use of values for "WICK" and "DENSITY"), may be mathematically computed with a degree of accuracy and reliability that far exceeds the techniques available through commercial software.

A flow diagram of a preferred color blending algorithm, partly based on Kubelka-Munk Theory (see, e.g., James H. Nobbs, "Kubelka-Munk Theory and the Prediction of Reflectance," Ref. Prog. Coloration 15 (1985), Pages 66–75; see also, e.g., Rolf G. Kuehni, Color—An Introduction to Practice and Principles, John Wiley & Sons, 1997), is shown in FIGS. 3A through 3C. Typical input values for this algorithm are discussed below.

Generally speaking, the Kubelka-Munk relationship relates, in relatively simple terms, the light absorption and light scattering behavior of a material to its reflectivity at each wavelength of light. For opaque materials (such as most textile substrates), the relationship may be expressed as follows:

$$k/s=(1-r)^2/2r$$

This formula effectively models the "k over s" or "k/s" parameter, which represents the ratio of a material's light absorption coefficient "k" and its light scattering coefficient "s" at some specified wavelength to the light reflectivity "r" of the material (colored or uncolored).

As is appropriate for non-pigment printing of textile substrates (i.e., involving the use of transparent colorants), the color blending algorithm disclosed herein assumes that the light scattering for a given dyed substrate is due only to the substrate and is therefore relatively constant. Importantly, because k and s are proportional to the number of light absorbers and scatterers, these parameters have been found to scale linearly, and may be added for each applied dye. Other physical characteristics such as unused substrate dye capacity (see inputs to algorithm) may also be accommodated. In cases where stratified, transparent colors (i.e., as achieved through use of colorants that absorb, but do not scatter, light) are applied in a light scattering, isotropic medium, use of Kubelka-Munk theory in the manner disclosed herein results in an unusually good prediction of the resulting color (blended or unblended), as that color would appear on the specified substrate. Kubelka-Munk theory, as embodied herein, is not nearly so well suited to situations in which light scattering colorants are placed on the surface of a subsrate with relatively little absorption, as on paper of the kind typically used in ink jet printing applications.

The Color Blending Algorithm disclosed herein introduces the effects of a variety of such substrate properties by the use of two user-specified parameters: (1) WICK (a user-specified parameter intended to accommodate a variety of physical characteristics, such as viscosity of colorant solutions, capillary structure of the substrate, yarn or pile lay, twist, and compaction, and the surface tension of the colorant solution on the substrate, that affects the degree of colorant mixing on the substrate) and (2) DENSITY (another user-specified parameter intended to accommodate a variety of physical characteristics such as yarn or pile lay, twist, and compaction, the shape of the yarn fiber cross section, and the index of refraction and de-lusterant content of the materials comprising the substrate whereby the substrate affects color saturation or chroma).

The WICK parameter has values 0 through 3, with loop pile carpet typically using values 0 through 1, and cut pile carpet typically using values 2 through 3. The DENSITY parameter has values 0 or greater, with about 5 as a practical upper limit. DENSITY equals 1 for the substrate chosen as the standard. Values smaller than 1 correspond to substrates less dense than the standard substrate, and result in less chromatic and lighter colors. Values greater than 1 correspond to substrates more dense than the standard substrates, and result in more chromatic and darker colors. For example, if cut pile carpet is chosen as the standard so DENSITY equals 1, then the same colors applied to loop pile has DENSITY equal to about 0.3. Conversely, if loop pile carpet is chosen as the standard so DENSITY equals 1, then the same colors applied to cut pile has DENSITY equal to about 3. When WICK equals 0, and DENSITY equals 1, the color blend model of this invention reduces to standard Kubelka-Munk Theory.

For simplicity, assume that the computer display device is a cathode ray tube (CRT). GAMMA characterizes the relationship between CRT RGB digital counts and the resulting intensity of the displayed color (RGB phosphors). GAMMA typically ranges from 1 to 3, with 2 a typical value. When an LCD-type display is used, the procedure relating RGB values to color intensity must be appropriately modified, but the Color Blending Algorithm is unchanged. The Color Blending Algorithm also relates the input of the Algorithm (RGB values of process colors) from the CRT display device to K/S values of the colorants used to predict blend color. The Algorithm itself does not depend on the type of computer display device; the inclusion of GAMMA merely relates the output of the algorithm to the CRT display device so that the colors calculated by the Algorithm may be accurately displayed.

Note that, if spectral values are used in place of RGB values to define color, then the spectral values take the place of the normalized gamma-corrected RGB values in FIG. 3B. In addition, the RGB loop in FIG. 3C becomes a loop for each spectral value and the box showing computation of RGB total instead computes the spectral value total, using the relationship $$r_{TOTAL}=(1+(K/S)_{TOTAL})-[(1+(K/S)_{TOTAL})^2-1]^{1/2} \quad \text{(Spectral Equation)}$$

where $r_{TOTAL}$ is the spectral value of the resulting color as applied to the substrate. Methods of converting spectral values to RGB values, and vice versa, will be familiar to those skilled in the art.

In the preferred techniques disclosed herein, the available color palette is a greatly expanded one, in that the chosen process colors are not only used individually, but are also used to generate blended colors that are available for use in coloring individual pixels—intrapixel blends that are comprised of two or more different colors (colorants) that are applied to the same pixel or dot area of the substrate, thereby forming a physical blending of colors within that pixel. With reference to the dye jet patterning machine of FIG. 1, this may be achieved by activating, in an approved sequence, the same respective dye jet(s) located on two or more different arrays, thereby delivering a predetermined (but not necessarily equal) quantity of each of two or more different dyes to the same location or pixel on the substrate as the substrate moves under each of the arrays.

This ability greatly expands the range of palette colors that are available to color a given individual pixel and thereby greatly enhances the ability of dithering algorithms to generate perceived colors that closely match target colors. This additional versatility can make the initial choice of process colors less important to the overall ability of the system to reproduce a desired target color, and thereby can provide for the generation of a wide range of perceived colors on substrates with the use of a relatively small number of different process colors. Significantly and unexpectedly, this superior matching capability is achieved with individual pixels that are colored quite unlike any of the process colors, and, as a result of visual blending of dithered palette colors, also may be excellent matches to the desired target colors.

The set of blend colors may be determined by a series of incremental concentrations that results in a wide range of respective blend combinations (i.e., relative dye concentrations, as expressed as a percentage of the substrate's total liquid dye absorption capacity). Theoretically, relative concentrations of the two different colorants can range between, for example, 100 to 0 percent and 0 to 100 percent, respectively. In most systems, however, there may be equipment limitations that make certain concentrations or changes in concentrations impractical (e.g., response time limitations that result in an inability to deliver micro- or pico-liter quantities of liquid colorant with accuracy and precision) or other physical constraints of the patterning system in use. Where the substrate is moving under the dye jet arrays at a relatively high speed, the response time of the valves responsible for metering the dye onto the substrate may be insufficient to provide a relative dye concentration less than, say, 20 percent, because the valve is incapable of precisely and accurately metering any smaller quantity of dye (which may correspond to the ability of the valve to turn on and off within a very short time interval).

In addition to this limitation on the minimum quantity of dye that can be assigned to a given pixel (i.e., minimum concentration quantity), there may also be limitations on the size of the incremental change in dye quantity that can be assigned to a given valve (i.e., minimum concentration increment). For example, it may be difficult for the valve to meter precisely the change necessary to reproduce reliably a 30%/70% ratio and a 31%/69% ratio of the same two dyes. In order to maintain a manageable number of dye combinations, to accommodate a likely inability to meter dyes with the required precision and accuracy, and to reflect an inability of the human eye to distinguish small changes in the relative concentrations of dye mixtures, it is practical to limit the relative concentrations (expressed as a percentage of the absorption capacity of the substrate) of the various dyes (i.e., the minimum concentration increment) to certain predetermined incremental values.

For example, rather than attempt to model color changes that occur when the relative concentration (i.e., proportion) of blue and yellow, mixed together, is changed from 40%/60% to, say, 41%/59%, it has been found to be helpful to limit the increments by which the relative concentration of constituent dyes can be adjusted. If a minimum concentration increment of, for example, 5 percent is selected to be appropriate, then the relative concentrations of blue and yellow (assuming a minimum colorant concentration of 20%) might include the ratios 20/80, 25/75, 30/70, 35/65, 40160, 45/55, 50/50, and so on, up to 80/20.

Provided no concentration is less than the pre-determined 20 percent minimum concentration dictated by equipment limitations, other two-way combinations of the process colors may be generated, for example, using different, larger increments (e.g., 10, 12.5, 20, 33, or some other ratio). Color combinations involving three (or more) colors are also contemplated in various concentrations. For example, all possible three-way combinations having a minimum concentration quantity of 20 percent and a minimum concentration increment of 5 percent (or some other number) could be calculated, as could all possible four-way or five-way combinations.

Although as a practical matter, the color palette used in most dithering algorithms is limited to 256 colors, theoretically, for N different colorants, it is possible to consider all possible blend combinations involving two colors, then three colors, and so on, up to N colors. In such blends, the the relative concentration of each of the selected colorants sum to a maximum value of 100%, where 100% represents the maximum liquid absorbent capacity of the substrate at that specific location. It is contemplated that, under certain conditions and for certain colors, it may be desirable for the relative concentration of colorants to sum to a number less than 100% (resulting in undersaturation of the substrate within that pixel).

By enlarging and making more realistic the available palette of colors that can be used in a dithered pattern, the overall quality of the dithered pattern as a representation of the target pattern is likely to be greatly enhanced. As an additional benefit, use of such a color predictive system allows the designer to account for the "look" of a given design on a variety of different colored substrates, and provides additional flexibility in the manufacturing process, because the color and other physical characteristics of the substrate can be accounted for as part of the color blending operation (and can also be used to accommodate such substrate characteristics even if non-blended process colors are employed exclusively). If desired, the color palette can be reduced to achieve particular aesthetic effects.

A significant aspect of the process disclosed herein lies in the capability of mathematically describing the colors that will be generated by the in situ blending of two or more colorants in specified concentrations in a way that will closely correspond with the actual observed color of the blend as it appears on the selected substrate. Having the capacity to perform this calculation in a way that accommodates both the color and the construction of the substrate (as incorporated into the WICK and DENSITY parameters) provides the chosen conventional mathematically-based dithering algorithm with an excellent representation of the available palette of colors—as those colors will appear on the substrate—that can be generated through the in situ blending process.

A representative series of process steps is depicted in the flow diagram of FIG. 2, the steps of which are discussed below. It should be understood that the steps specified in FIG. 2 are for illustrative purposes only, and may be combined or rearranged in various ways. For example, the determination of the RGB values for process colors in Block 25 is described as using a white substrate and nominal values for wicking and absorption. This is to establish a "standard" that may then be modified for use on a different, colored substrate (as is suggested in Block 30), without the need for physically re-establishing the process color RGB values. If, however, a specific, colored substrate is of primary interest, then the RGB determination described in Block 25 can be carried out using that specific colored substrate, thereby making unnecessary any accommodation for substrate color or other physical characteristics in Block 30.

As shown in FIG. 2:

Block 10: Input and store, in RGB form, the target pattern or image or target solid color.

Block 15: Specify the substrate upon which the pattern will be placed, and determine values for the relevant physical parameters, such as WICK, DENSITY, and color (expressed as RGB values). Store values for later use.

Block 20: Select the dyes or liquid colorants that will be loaded into the dye injection machine. These dyes will comprise the process colors that will be used to generate the perceived colors that, desirably, will closely mimic as many of the target colors of the patterned substrate as possible. The number of process colors can vary from one to the maximum number of different dyes that can be printed by the patterning device—in the case of the dye injection machine contemplated herein, this number corresponds to the maximum number of arrays. The complete set of process colors is known as a "colorway".

Block 25: Determine the RGB values for the process colors chosen in Block 20. This can be accomplished, for example, through use of a spectrophotometer, by scanning a sample dyed with the selected colorant, or by visually comparing a sample of the colorant, applied to a white substrate at 100% concentration (i.e., at full substrate absorbency), with a candidate color block generated on a computer monitor by a computer graphics program such as Adobe Photoshop®. By making successive adjustments to the color block as it appears on the monitor until a visual match is achieved, the RGB values of the process color (as printed on the white substrate) can be determined. Store the results for later use.

Block 30: If the substrate specified in Block 15 is not the same as the substrate used to determine the RGB values of the process colors in Block 25, use the Color Blending Algorithm described in FIG. 3 (hereinafter referred to as "C.B.A.") to predict and display the necessary adjustment to process color RGB values due to the color and other physical characteristics of the substrate specified in Block 15. Store the results for later use.

Block 35. Determine all practical combinations and concentrations of the various process colors that are to be deemed "appropriate" for generating the blended colors to be included as part of the color palette that will be made available to the dithering algorithm. Determining these various combinations and concentrations can be done in several ways, but need not be any more complex than specifying all the various colorants to be used in making up the color blends, and specifying the possible relative concentrations of any single colorant (e.g., from 20% to 80% in 5% increments) comprising the blend. Note that the RGB specification of these hypothetical blended colors need not be determined at this stage (see Block 40). Store the results for later use.

Block 40: Use the C.B.A. to predict RGB values for all the appropriate blends identified in Block 35, similar to what was done for process colors in Block 30. Store the results for later use.

Block 45: Process the target pattern or image of Block 10, using an appropriate dithering algorithm. Colors available to the algorithm are limited to substrate color, "substrate-adjusted" process colors, and "substrate-adjusted" blended colors.

Block 50: Display the dithered image. Adjust the image as necessary (in accordance with artistic considerations, etc.), and make corresponding adjustments, if required, to the choice of process colors, combinations and concentrations of process colors used to construct blended colors, and all associated substrate-adjusted RGB values calculated in preceding Blocks. Store the results for later use.

At this point, the process of this invention has generated an image on a computer monitor that reproduces, in a way formerly unavailable, the pattern to be reproduced as it will appear on the substrate of interest.

Block 55: Use concentration data of Block 35 (which are expressed in terms of the absorption capacity of the substrate) to create colorant applicator firing time instructions for all colors in the dithering algorithm color palette, i.e., process colors, blended colors, and substrate color (the latter will require a colorant applicator firing time of zero). Create and store a table associating palette colors with the colorant applicator firing time(s) necessary to reproduce the colors. It is anticipated that all blended colors will require colorant contributions from at least two different arrays (e.g., the blended color will require at least two different colorants), in accordance with the teachings of commonly-assigned U.S. Pat. Nos. 4,984,169 and 5,195,043.

Block 60: For each pixel in the adjusted dithered image of Block 50, use the table from Block 55 to convert the color assigned to that pixel to the associated colorant applicator firing time(s) necessary to dither that color at that pixel location on the substrate. Store the results, to be sent to the colorant applicators at the appropriate time (i.e, when that substrate location is passing under the specified colorant applicator).

Block 65: Supply colorants for the process colors using a substrate in the desired color, to the patterning machine, initiate the machine control system, make available the data calculated above, and manufacture the product.

The translation process from pixel-wise specification of colors to patterning instructions for the patterning device can be achieved most straightforwardly by creating in appropriate software a look-up table that associates a given color or color combination with a set of dye applicator-specific firing instructions. Preferably, this look-up table can then be accessed by the electronic control system of the patterning device to "translate" a desired color at a given pixel location in the pattern with the proper dye delivery quantities and sequences to generate that color on the substrate at that specific pixel location. It may be necessary to store the results of the table look-up to assure that the appropriate instructions for each colorant applicator on each color bar reach the proper applicator at the proper time—when the location on the substrate to be colored by that applicator is passing under that applicator. Details of one such process of the kind described above is set forth in commonly assigned U.S. Pat. Nos. 4,984,169 and 5,195,043, hereby incorporated by reference, the relevant teachings of which are set forth below and in the accompanying drawings.

For the sake of discussion, the following assumptions, conventions, and definitions are used herein. The term "dye jet" or "jet" refers to the applicator apparatus individually associated with the formation of each dye stream in the various arrays. It will be assumed that the substrate will be printed with a pattern having a resolution or print gauge of one-tenth inch as measured along the path under the arrays, i.e., the arrays will direct (or interrupt the flow of) dye onto the substrate in accordance with instructions given each time the substrate moves one-tenth inch along its path. This implies that a pattern line, as defined earlier (i.e., a continuous line of single pattern elements extending across the substrate), has a width or thickness of one-tenth inch.

Substrate speed along the conveyor will be assumed to be one linear inch per second, or five linear feet per minute. This implies that, during each time period in which the substrate moves one-tenth inch (i.e., each one-tenth second), which hereinafter may be referred to as a pattern cycle, each and every valve controlling the individual dye jets in the various arrays will receive an electronically encoded instruction which specifies (a) whether the valve should interrupt the flow of diverting air intersecting its respective dye jet and, if so, (b) the duration of such interruption. This time, during which the stream of dye is undeflected and contacts the substrate, may be referred to as "firing time" or the time during which a dye jet "fires" or is actuated. Firing time and dye contact time are synonymous.

Array sequence numbering, i.e., first, second, etc., refers to the order in which the substrate passes under or opposite the respective arrays. Similarly, "downstream" and "upstream" refer to the conveyor direction and opposite that direction, respectively. A total of eight arrays are assumed, each having four hundred eight individual dye jets, although the invention is by no means limited to such numbers and may easily adapted to support thousands of individual dye jets per array, and/or a greater number of individual arrays. Array-to-array spacing along the direction of substrate travel is assumed to be uniformly ten inches, i.e., one hundred pattern line widths. Note that one hundred pattern lines implies the processing of pattern data for one hundred pattern cycles.

For purposes of discussion, the electronic control system will be described in conjunction with the metered jet pattering apparatus discussed below and depicted in the Figures, to which this control system is particularly well suited. It should be understood, however, that this electronic control system may be used, perhaps with obvious modifications, in other devices where similar quantities of digitized data are rapidly distributed to a large number of individual elements.

FIG. 1 shows a jet dyeing apparatus 18 comprised of a set of eight individual color bars 36 positioned within frame 32. Each color bar 36 is comprised of a plurality of dye jets, perhaps several hundred in number, arranged in spaced alignment along the length of the color bar, which color bar extends across the width of substrate 15. Substrate 15, such as a textile fabric, is supplied from roll 34 as transported through frame 32 and thereby under each color bar 36 by conveyor 40 driven by a motor indicated generally at 38. After being transported under color bars 36, substrate 15 may be passed through other dyeing-related colors steps such as drying, fixing, etc.

Figure 4:
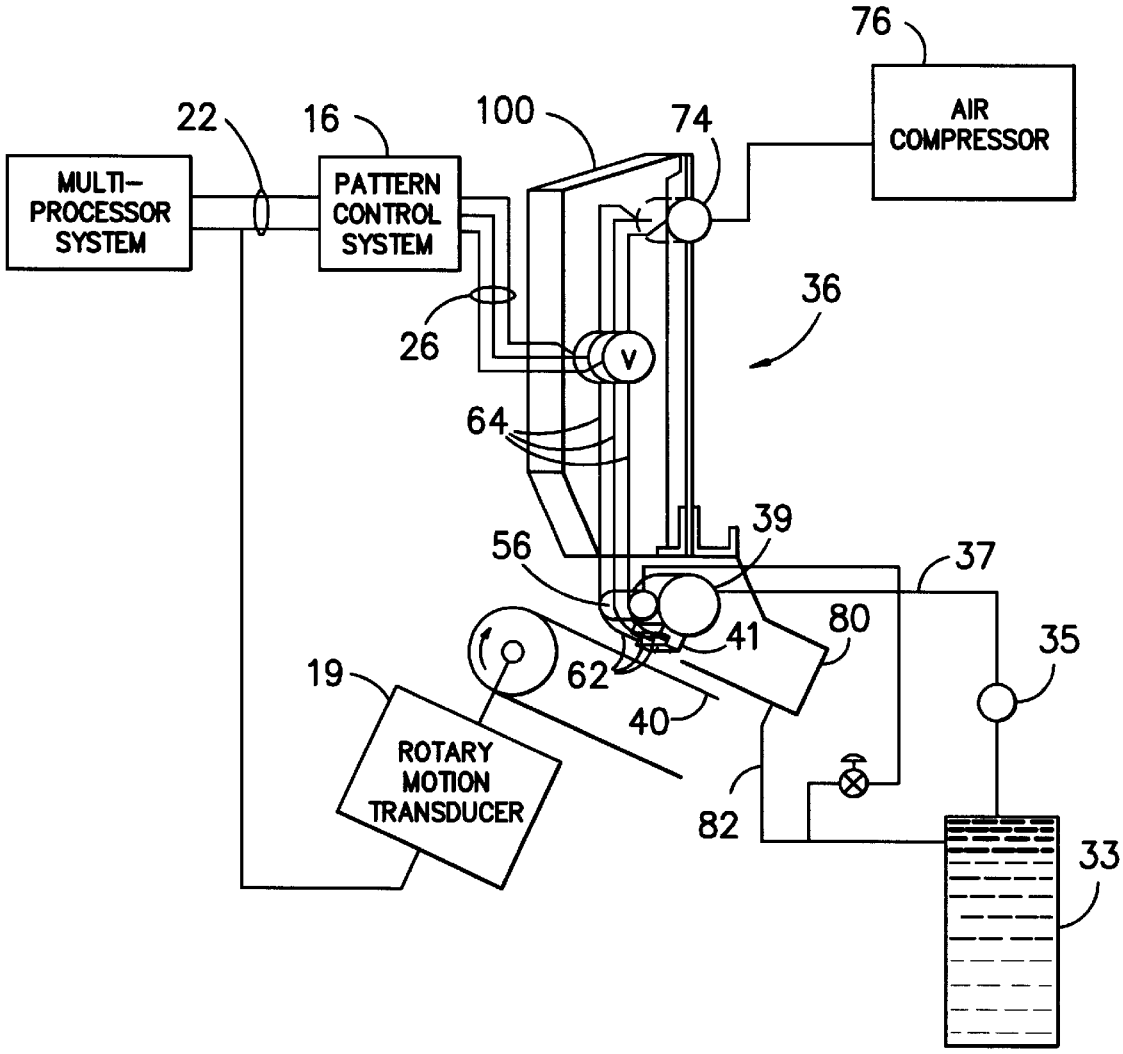
FIG. 4 is a schematic side elevation view of the apparatus of FIG. 1 showing only a single dye jet color bar and its operative connection to a liquid dye supply system as well as several electronic subsystems associated with the apparatus.

Referring to FIG. 4, there is shown in schematic form a side elevation of one color bar 36 comprising the jet dyeing apparatus 18 of FIG. 1. For each such color bar 36, a separate dye reservoir tank 33 supplies liquid dye under pressure by means of pump 35 and dye supply conduit means 37, to a primary dye manifold assembly 39 or the color bar 36. Primary manifold assembly 39 communicates with and supplies dye to dye sub-manifold assembly 41 at suitable locations along their respective lengths. Both manifold assembly 39 and sub-manifold assembly 41 extend across the width of conveyor 40 on which the substrate to be dyed is transported. Sub-manifold assembly 41 is provided with a plurality of spaced, generally downwardly directed dye passage outlets positioned across the width of conveyor 40 which produce a plurality of parallel dye streams which are directed onto the substrate surface to be patterned.

Positioned in alignment with an approximately perpendicular to each dye passage outlet (not shown) in sub-manifold assembly 41 is the outlet of an air deflection tube 62. Each tube 62 communicates by way of an air deflection conduit 64 with an individual electro-pneumatic valve, illustrated collectively at "V," which valve selectively interrupts the flow of air to air tube 62 in accordance with the pattern information supplied by pattern control system 16. Each valve is, in turn, connected by an air supply conduit to a pressurized air supply manifold 74 which is provided with pressurized air by air compressor 76. Each of the valves V, which may be, for example, of the electromagnetic solenoid type, are individually controlled by electrical signals received over bus 26 from the electronic pattern control system 16. The outlets of deflection tubes 62 direct streams of air which are aligned with and impinge against the downwardly directed dye passages within sub-manifold 41 and deflect such streams into a primary collection chamber or trough 80, form which liquid dye is removed, by means of a suitable dye collection conduit 82, to dye reservoir tank 33 for re-circulation.

Figure 7:
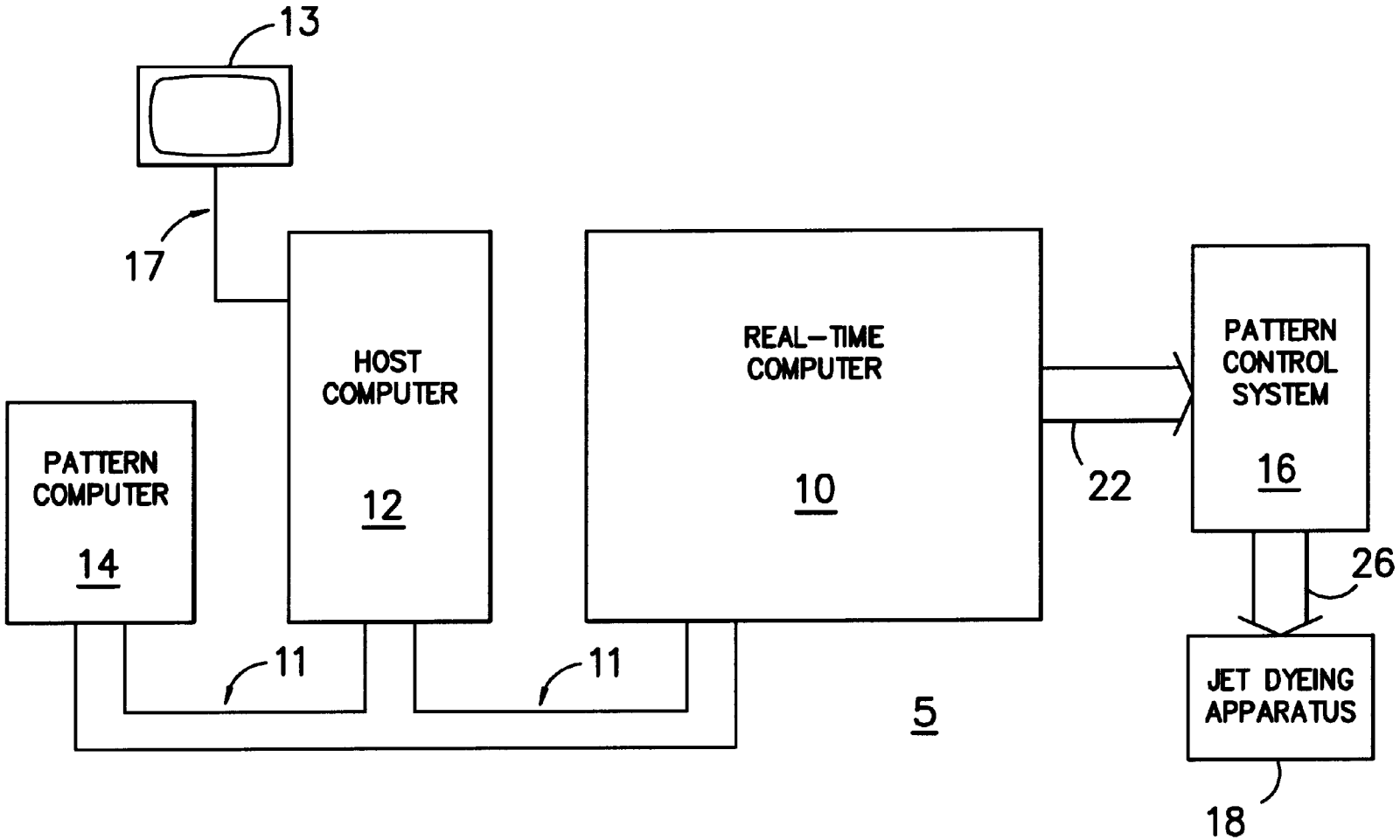
FIG. 7 is a block diagram illustrating a prior art multiprocessor and pattern control system environment in which the present invention may operate.

The pattern control system 16 receives pattern data over bus 22 from the multiprocessor system described in FIG. 7. Desired pattern information from control system 16 is transmitted to the solenoid valves of each color bar 36 at appropriate times in response to movement of the substrate under the color bars by conveyor 40, which movement is detected by suitable rotary motion sensor or transducer means 19 operatively associated with the conveyor 40 and connected to control system 16. The pattern control system 16 will be discussed in more detail below, in conjunction with reference to FIGS. 12 through 16.

Figure 5:
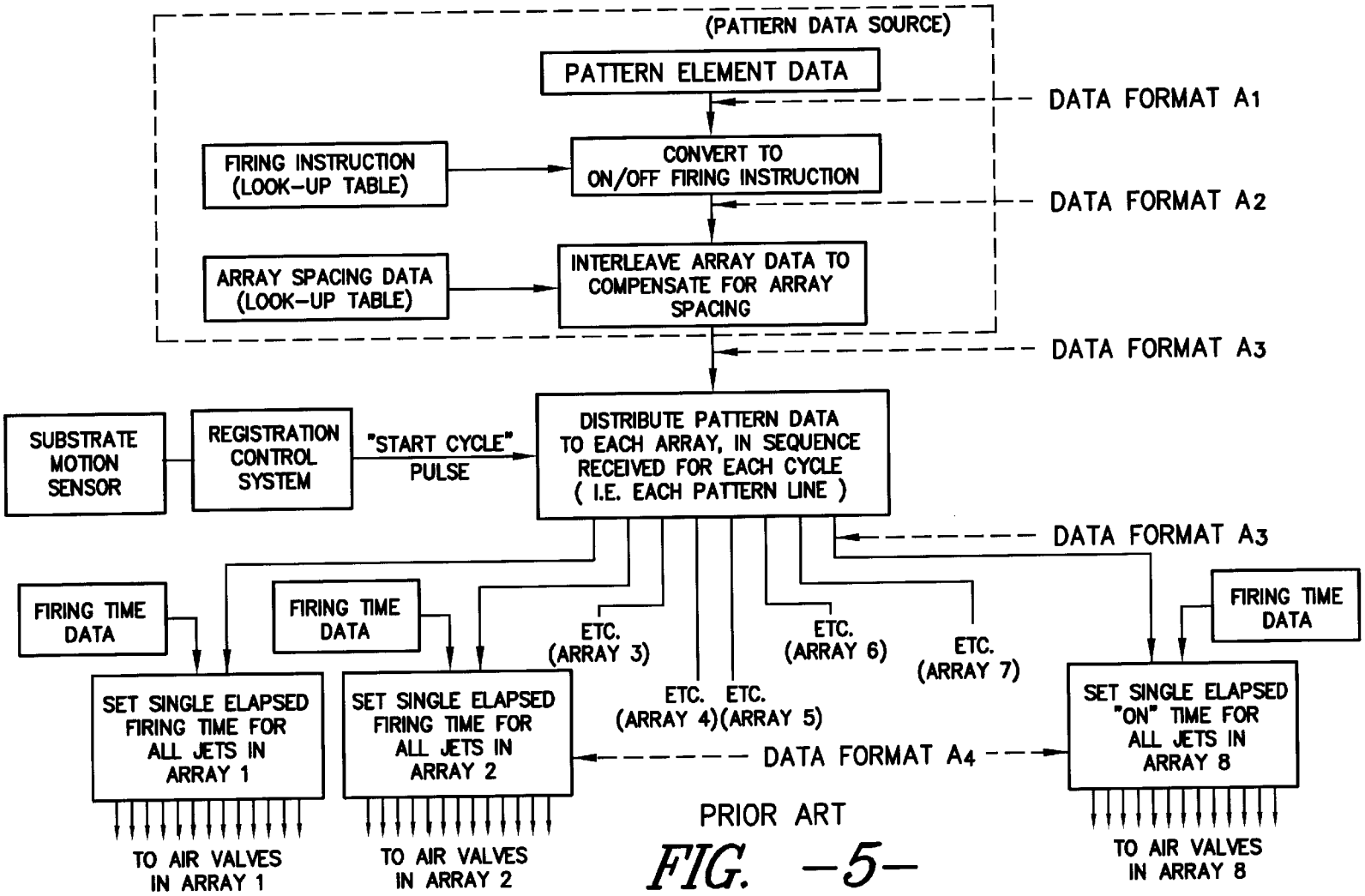
PRIOR ART FIG. -5-
FIG. 5 is a block diagram disclosing, in overview, an electronic control system of the prior art.
Figure 6:
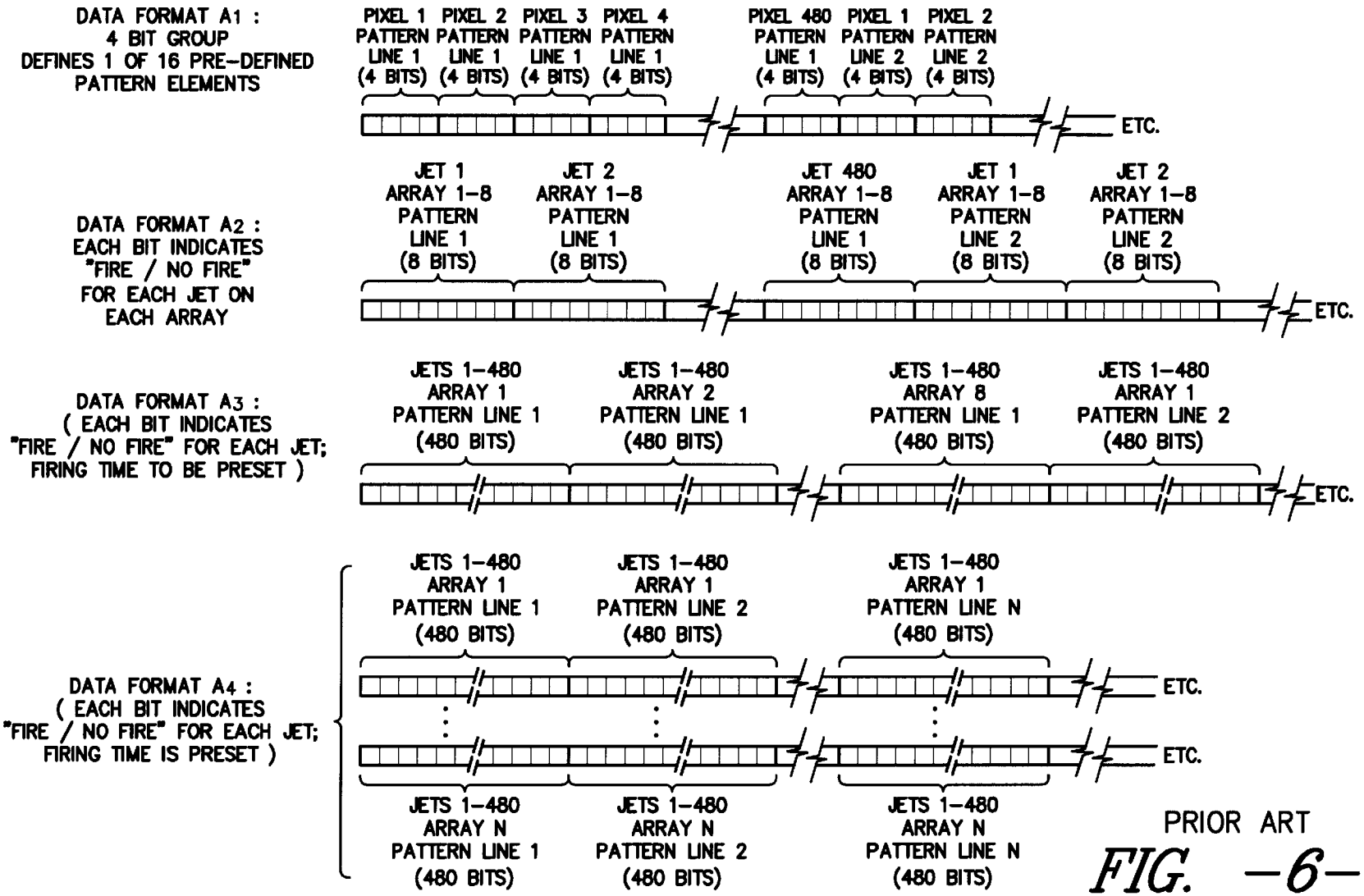
FIG. 6 schematically depicts the format of the pattern data at the previously known data processing stages indicated in FIG. 5.

For purposes of comparison, another control system of the prior art is disclosed in FIG. 5 and will be described in detail below. For purposes of explanation, the format of the patterning data or patterning instructions for this prior art control system, as indicated in FIG. 5, is schematically depicted in FIG. 6. As shown, the pattern element data (in Data Format A1) is first converted to "on/off" firing instructions (referring to the de-actuation or actuation, respectively, of the diverting air associated with the individual dye streams) by electronically associating the "raw" pattern data with pre-generated firing instruction data from a computer generated look-up table ("LUT"). This firing instruction data merely specifies, using a single logical bit for each jet, which jets in a given array shall fire during a given pattern cycle, and is represented by Data Format A2 of FIG. 6.

In generating such look-up tables, the raw pattern data must first be converted to "on/off" firing instructions. The control system accepts the raw source pattern data in the form of a series of pixel codes. The pixel codes define those distinct areas of the pattern which may be assigned a distinguishing color. Each code specifies, for each pattern line, the dye jet response for a given dye jet position on each and every array. In a system having eight color bars, for example, each pixel code therefore controls the response of eight separate dye jets (one per color bar) with respect to a single pattern line. The term "pattern line," as used herein, is intended to describe a continuous line of single pattern elements extending across the substrate parallel to the patterning color bars. Such pattern lines have a thickness, measured in the direction of substrate travel, equal to the maximum permitted amount of substrate travel under the patterning color bars between color bar pattern data updates. The term "patterning element," as used herein, is intended to be interchangeable with the term "pixel" as that term is used herein with respect to the generation of the pattern.

An operator's interface, such as a workstation terminal, may be coupled to the host computer in the multiprocessor system. The workstation serves as the operator's interface for providing the input parameters to the host computer for each job of patterns to be generated on the substrate of the textile dyeing apparatus.

The operator enters the input parameters as a "RUN LIST" which designates the type of substrate to be dyed and the types of patterns to be printed for each job. The RUN LIST input, for the type of base to be dyed, accesses a base file which includes the firing time for each of the color bars in the dyeing apparatus. The RUN LIST entry, for the type of pattern, accesses a stock keeping unit (SKU) file. The SKU file designates for each pixel code used in the pattern, the respective color bar associated therewith. With this information, the multiprocessor and control systems generate the individual firing instructions for each jet in each color bar.

The system described below produces the look-up tables from the operator's RUN LIST in a four-phase operation.

First, the type of RUN LIST entry is determined and an appropriate table generated to store its information. If an entry is a Base entry, then a firing time table is generated for the particular substrate associated with the Base entry. If the entry is determined to be a Color entry, the second phase of operation generates a machine color table for the color loading configuration. If the entry is an SKU entry, then the third phase generates a pattern color table including the information from the respective SKU file identified by the SKU entry. The pattern color table associates each pixel code with a particular color name rather than a fixed color bar in the jet dying apparatus a previously was done. Thus, for example the pixel code A is associated with a color name such as "red" rather than a particular color bar.

The fourth phase of operation generates the look-up tables from the data provided in the firing time table, machine color table and pattern color table. In this system, the operator only needs to input the color entries for the machine color loading configuration to correctly generate the proper look-up tables for the requested pattern and substrate.

It is an advantage to reduce the amount of storage space necessary by eliminating the need for storing converted firing instructions. Further, a series of jobs can be continuously printed without requiring machine "down" time previously necessary to clean and reload a particular color bar. The operator may randomly load the colors into the machine's color bars irrespective of the patterns to be run. The system software automatically generates the correct look-up tables for the particular machine configuration.

Referring to FIG. 7, the multiprocessor patterning system 5 is shown having a host computer 12 coupled via a bus 11 to a real-time computer 10. Optional pattern computer 14 is further coupled to the host computer 12 and real-time computer 10 by the bus 11. It is readily apparent that the coupling of the pattern computer 14, host computer 12 and real-time computer 10 may be by any means for coupling a local area network (LAN) such as an Ethernet bus. Pattern control system 16 is coupled via bus 26 to jet dyeing apparatus 18. The pattern control system 16 received input data over bus 22 from the real-time computer 10. Optional pattern computer 14 may be provided to allow a user of the system to quickly create their own pattern design. Alternatively, pattern designs may be pre-loaded onto magnetic or optical media for reading into the system.

Each design has an associated stock keeping unit (SKU) file for providing the set-up parameters for the system for each pattern. An SKU file includes the pattern name for the pattern to be printed, the associated color names for each pixel code in the pattern, and a base reference ID identifying the substrate on which the pattern is to be printed.

The base reference ID accesses a base file containing the firing times for each color bar in the jet dyeing apparatus 18 for that particular substrate. A simplified example of an SKU file for several patterns and a Base file are given below in Tables A and B.

TABLE A

| SKU FILE | |
|---|---|
| SKU | ABC |
| Pixel Code A = | Red |
| Pixel Code B = | Blue |
| Base Reference = | WXYZ |
| SKU | ADE |
| Pixel Code A = | 50% Red |
| | 50% Blue |
| Pixel Code C = | Green |
| SKU | CDF |
| Pixel Code A = | Green |
| Pixel Code B = | Blue |
| Pixel Code C = | 25% Yellow |
| | 50% Red |
| | 25% Blue |

TABLE B

| BASE FILE | |
|---|---|
| BASE | WXYZ |
| Color Bar 1 = | 10 ms |
| Color Bar 2 = | 10 ms |
| Color Bar 3 = | 20 ms |
| Color Bar 4 = | 15 ms |

Referring back to FIG. 7, a computer terminal 13 may be coupled via a suitable connection 17, e.g., a standard RS232 cable, to the host computer 12. The terminal 13 then serves as the operator's interface for providing input parameters in the form of a RUN LIST to the host computer 12 for each job or series of jobs to be generated on the substrate by jet dyeing apparatus 18. The RUN LIST is simply a series of instructions provided to the host computer 12 for retrieving the SKU file and base file for printing a requested pattern. The RUN LIST further includes the machine set-up or "color loading" for each of the color bars in the jet dyeing apparatus 18. An example of a typical RUN LIST is given below in Table C wherein the SKU files are identified by a three-character code and the Base file is identified by a four-character code.

TABLE C

| OPERATOR'S RUN LIST | |
|---|---|
| Base = | WXYZ |
| Color Bar 1 = | Red |
| Color Bar 2 = | Blue |
| Color Bar 3 = | Green |
| Color Bar 4 = | Yellow |
| SKU | ABC |
| SKU | ADE |
| SKU | CDF |

The host computer 12 fetches the pattern data from the pattern computer 14 or other storage source (not shown) and sets it up for processing by the real-time computer 10. The real-time computer 10 functions to ensure that the raw source pattern data is properly output to the pattern control system 16 and hence provided to the individual jets in the jet dyeing apparatus 18.

Figure 8:
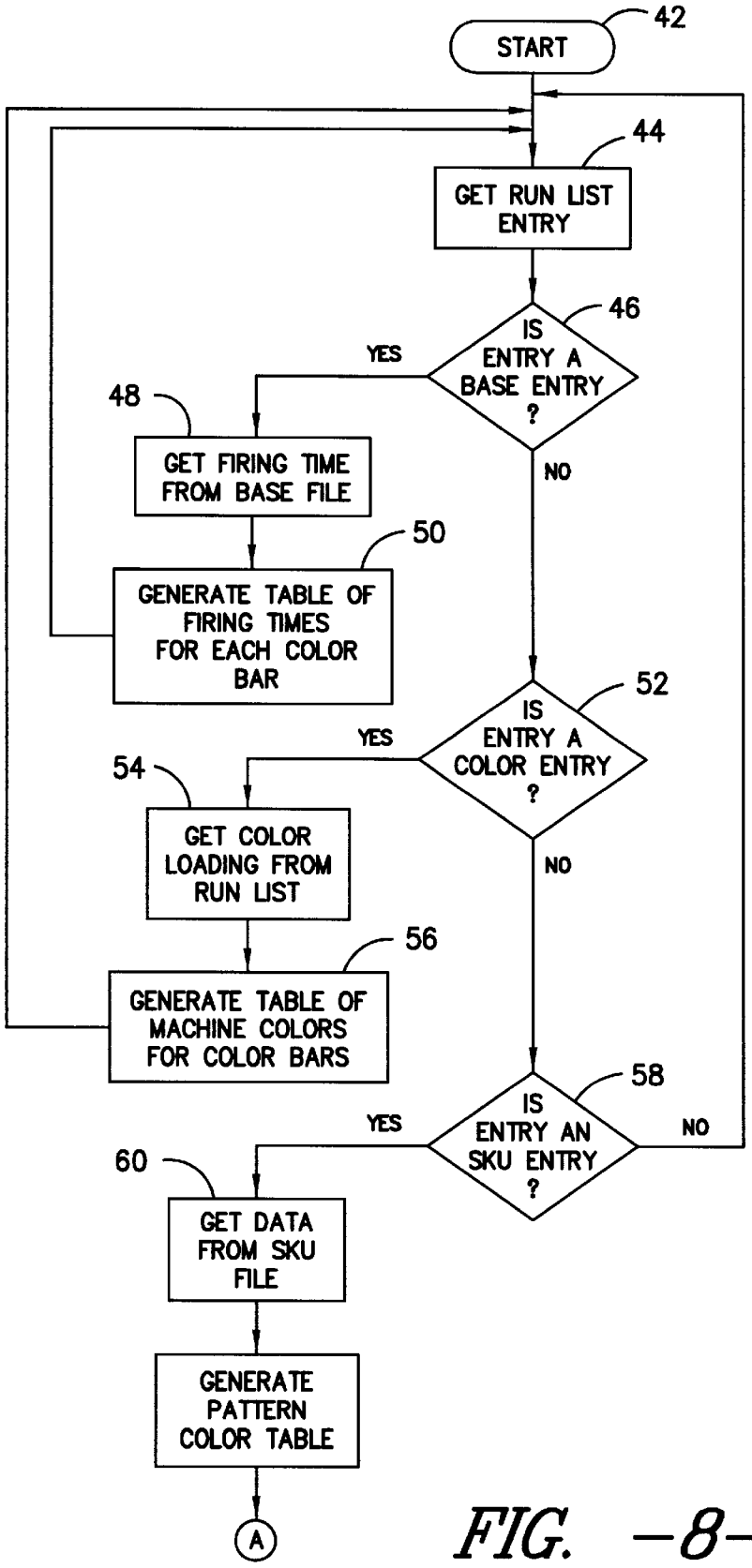
FIG. 8 is a flow chart relating to one prior art method by which look-up tables may be generated for using the patterns developed herein to direct a patterning device.

FIG. 8 shows a flow chart illustrating the software operation for automatically generating the look-up tables associated with each color bar for each requested pattern. The system makes use of the RUN LIST generated by the operator at terminal 13 (FIG. 7) for producing the look-up tables for the requested pattern in the requested color combination. As discussed above, the system operates in four phases, the first three phases retrieve the file information and the machine color loading configuration necessary to produce the look-up tables for the requested pattern and the fourth phase actually generates the look-up tables to be used.

The machine operator need only input in his RUN LIST (1) which color bars contain which color, i.e., the color bar machine configuration loading, (2) what carpet base is being run, e.g., Base WXYZ, Base HIJK, etc. and (3) the requested pattern, e.g., SKU=ABC, ADE, CDF, etc. As shown in FIG. 8, the software system starts (at 42) by obtaining a RUN LIST entry 44 from the operator's RUN LIST. Next, the system determines the type of RUN LIST entry, i.e., Base entry, color entry, or SKU entry as indicated by steps 46, 52 and 58. If the RUN LIST entry is a Base entry, then the system retrieves the Base file for that entry and obtains the firing times for each color bar for the respective substrate base as shown in step 48. From the firing times, the system generates a firing time table for each color bar in the jet dyeing apparatus at step 50. Once the firing time table has been generated, the system loops back to retrieve the next RUN LIST entry.

If the RUN LIST entry is a color entry, then the system obtains the color loading indicated by the RUN LIST (step 45). The machine configuration color loading is determined by the operator depending upon which colors are loaded into the respective dye tanks 33 (FIG. 4) for each color bar 36 in the jet dyeing apparatus 18 (FIG. 1). From the color loading, a table of machine colors for the color bars is generated, as indicated by step 56, and the system then loops to obtain the next RUN LIST entry.

If the RUN LIST entry is an SKU entry, then the system obtains the data from the SKU file, stored elsewhere in the system, such as in the pattern computer 14 (FIG. 7) or optical disk storage (not shown). From the SKU file, a pattern color table is generated, step 61, containing the colors associated with each pixel code in the pattern. Once the firing time table, machine color table, and pattern color table have been generated for a respective job, then the final phase of actually generating the look-up table ("LUT") is performed as shown in the flow chart of FIG. 9.

The system automatically generates the look-up tables for each color bar for the respective pattern, step 66, by first obtaining a first pixel code from the pattern color table, as indicated at step 68. Next, at step 70, using the pixel code previously obtained, the first color and percent of color from the pattern color table are obtained. Using the color, the system next gets the color bar number associated with that color from the machine color table, step 72. From the color bar number, the system obtains the firing time for the respective color bar from the firing time table as indicated by step 78. At step 84, a modified firing time is obtained by multiplying the percent of color, obtained in step 70, and the firing time obtained in step 87. The modified firing time is then stored in the look-up table for the given pixel code and color bar number as indicated by step 86.

The system then determines whether all colors for the particular pixel code have been found, step 88. If not, the system loops back to step 70 wherein the next color and percent of color are obtained from the pattern color table for the particular pixel code. This loop, steps 70–88, continues to repeat until all of the colors for the particular pixel code have been found.

At this point, the system determines whether all pixel codes have been loaded into the look-up table. If not, the system reverts to step 68 wherein the next pixel code is obtained from the pattern color table. The steps 68–90 then continue to loop until all pixel codes have been loaded into the look-up table. At this point, the entire look-up table for the requested pattern has been generated and is sent to the jet dyeing apparatus (step 92) before completing (step 94).

Figure 9:
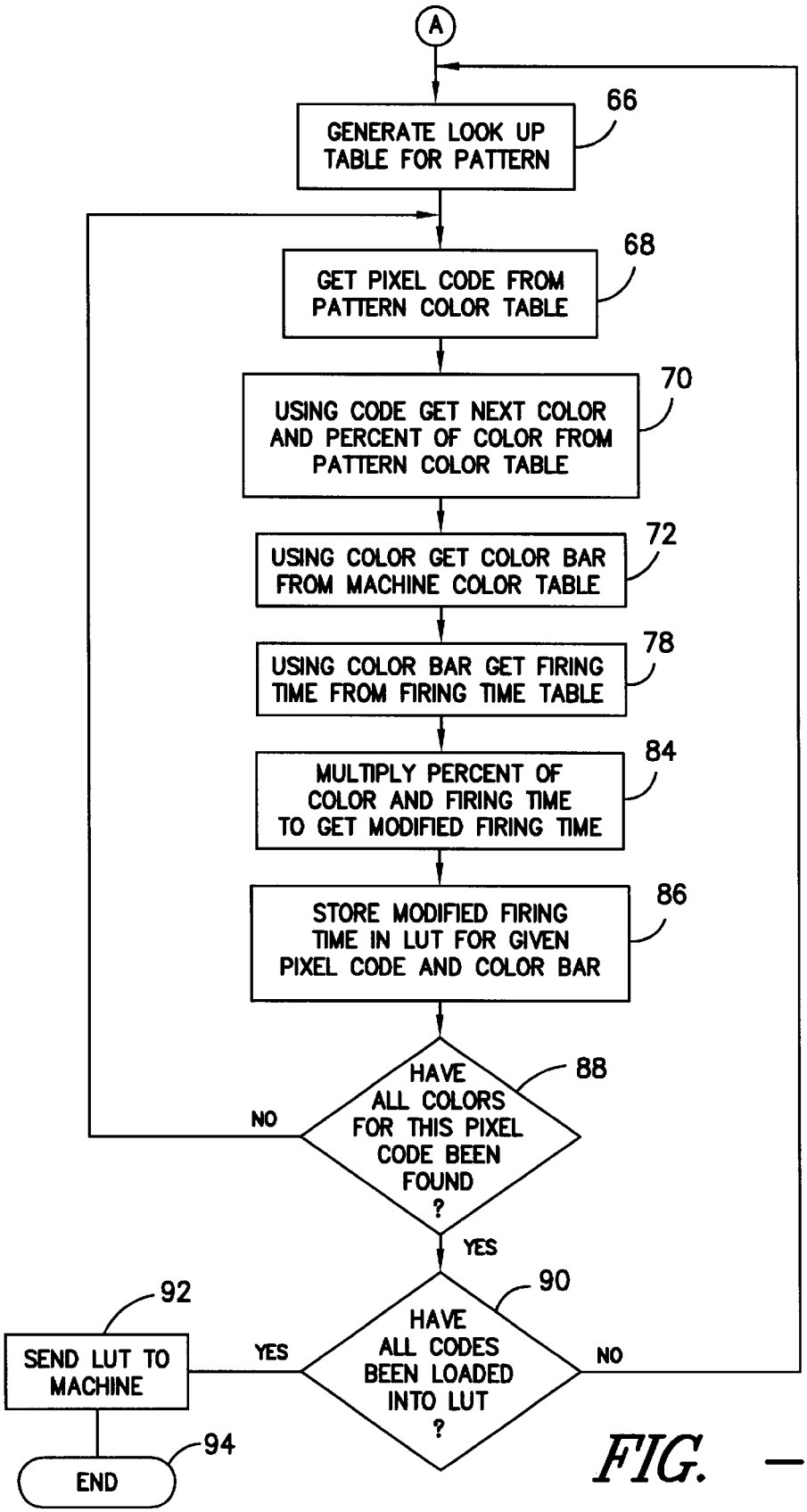
FIG. 9 is a continuation of the flow chart of FIG. 8.

The system software depicted by the flow charts shown in FIGS. 8 and 9 repeats itself each time new look-up tables are required. This may occur due to a change in the pattern to be printed, a change in the substrate or base upon which the pattern is to be printed or when the machine is configured differently. In this respect, it may be necessary to reconfigure the machine due to a malfunction of one or more of the color bars. For example, if the apparatus includes eight color bars, and only two colors are necessary for the pattern, if one of the color bars malfunctions, then that color can be loaded into one of the remaining six color bars and new look-up tables can be generated to print the desired pattern.

A simplified series of examples are described below to illustrate the operation of the present invention. For purposes of illustration in these examples, a jet dyeing apparatus 18 is assumed to contain only four color bars. Further, the SKU files and Base files are as given above in Tables A and B. The exemplary operator's RUN LIST, given in Table C above, will be used to process the jobs for SKU files ABC, ADE and CDF.

In operation, the first RUN LIST entry "Base=WXYZ" is obtained (step 44). The system determines that the entry is a Base entry and obtains the firing times for Base WXYZ from the Base file (step 48). The system then generates the firing time table for each color bar as shown in FIG. 10A wherein the firing times are given in milliseconds (ms).

The next RUN LIST entry, "Color Bar 1=red," is obtained and it is determined that it is for a color entry (step 52). The system obtains the color loading from the RUN LIST and generates the table of machine colors for the color bars as shown in FIG. 10B. Each of the color entries in the RUN LIST is obtained to complete the machine color table.

The system then obtains the next RUN LIST entry, "SKU=ABC," and obtains the corresponding data from the respective SKU file (step 60). From the SKU data, the pattern color table shown in FIG. 10C is obtained.

At this point, the system begins generating the actual look-up table for the requested pattern identified by SKU ABC. The first pixel code A and its associated color, red, are obtained from the pattern color table. Next, the system identifies the color red with color bar 1 from the machine color table. Finally, the firing time for color bar 1 is obtained from the firing time table. Thus, in our example, a firing time of 10 ms, associated with color bar 1, is stored in the look-up table shown in FIG. 10D for the respective pixel code A.

The system then repeats itself for pixel code B resulting in the storage of a 10 ms firing time for color bar 2 in the look-up table. Any look-up entry not filled by the system is assumed to contain a zero firing time or "null" firing time. Thus, the system generates the look-up tables shown in FIG. 10D for the requested pattern ABC.

Continuing the example, the next RUN LIST entry: SKU=ADE: is obtained from the operator's RUN LIST. This indicates a new pattern is requested and, in all likelihood, new look-up tables would need to be generated. Tables 11A-11C indicated the firing time table, machine color table and pattern color table, respectively, associated with SKU ADE.

For this example, the firing time table shown in FIG. 11A is identical to the previous example as the same Base WXYZ is being run through the apparatus. Similarly, the machine color table remains the same as none of the color bar color loadings have been changed. The pattern color table, however, differs from the preceding example because a new pattern, SKU ADE is being run. As shown in FIG. 11C and the SKU file associated with the pattern ADE, for pixel code A, the associated colors include 50% red and 50% blue—signifying an in situ blend of these two colors. Thus, when generating the look-up table entries, steps 70–88 of FIG. 9 would loop twice, i.e., once for 50% red and a second time for the next color, 50% blue.

In this example, the look-up tables shown in FIG. 11D are generated by the system. Pixel code a is first obtained from the pattern color table and its first color and percent of color, 50% red, are obtained (step 70). Next, the system associates the color red with color bar number 1 and then obtains the firing time of 10 milliseconds for that color bar from the firing time table. This firing time, 10 milliseconds, is multiplied by the percent of the color to obtain the modified firing time. Thus, 10 milliseconds times 50% equals 5 milliseconds which is then stored in the look-up table for the given pixel code and color bar.

Because all colors for this pixel code have not yet been found, the system loops back to step 70 (FIG. 9) and obtains the next color, i.e., 50% blue. This sequence of steps, 70–88, are repeated and the modified firing time stored in the look-up table (FIG. 11D). The operation then repeats for the remaining pixel codes in the pattern color table until the look-up tables are completed. It is apparent that by using percentages of colors, the colors can be shaded or blended within a given pixel to form other colors which are not loaded in the jet dying apparatus.

Returning to the operator's RUN LIST, the next entry "SKU=CDF" is obtained and the look-up tables of FIG. 11E are generated in accordance with the examples set forth above.

As shown above, the system automatically generates the look-up tables in response to the operator's RUN LIST. The operator only needs to input the type of base to be run, the SKU pattern requested, and the machine configuration. The system then generates the look-up tables without any costly time delays for reloading colors in the color bars. Further, if one of the color bars malfunctions, the operator can still possibly finish the RUN LIST without any delays. For example, assume a five color bar machine wherein only four of the color bars have been previously loaded as in the above examples. If, while preparing to run the pattern given by SKU ABC, the machine malfunctions and color bar 1 is no longer operative, then the operator can quickly load color bar 5 with the red color dye and the system will automatically generate new look-up tables in response thereto. (It is assumed the Base ID specifies a 10 ms firing time for color bar 5.) In this example, the look-up tables shown in FIG. 11F would be generated as opposed to the look-up tables shown in FIG. 10D for a non-malfunctioning system. In either event, the correct pattern having the correct colors would be printed.

Following the generation of the appropriate look-up tables, the individual "on/off" firing instructions must be directed to the appropriate dye jets in a way that accommodates the physical arrangement of the arrays on the machine. The proper firing instruction data corresponding to a given area of the substrate to be patterned must arrive at the initial array and at each downstream array at the exact time at which that given substrate area passes under the proper array. This is accomplished by interleaving the array data and inserting synthetic "off" data for downstream arrays at pattern start and for upstream arrays at pattern end, to effectively sequence and delay the arrival of pattern data to the downstream arrays until the substrate has had the opportunity to move into position under the downstream arrays. The data exiting this interleaving operation is in the form of a serial bit stream comprising, for a given pattern cycle, one bit per jet (indicating whether the jet should fire during this cycle) for each respective jet in each array, as indicated in Data Format A3 of FIG. 6.

This serial bit stream is then fed to a data distributor which, for each "start pattern cycle" pulse received from the registration control system (indicating a new pattern line is to begin), simply counts the proper number of bits corresponding to the number of jets in a given array, in the sequence such bits are received from the interleaving operation. When the proper number of bits necessary to comprise firing instructions for that entire array has been counted, that set of bits is sent, in serial form, to the proper array for further processing, as described below, and the counting procedure is begun again for the next array involved in the patterning operation. Each array, in a rotating sequence, is sent data in similar fashion for a given pattern line, and the process is repeated at each "start patterning cycle" pulse until the patterning of the substrate is completed.

Associated with each array is an electronically encoded value for the actual firing time to be used by that array for all patterning cycles associated with a given pattern. It is important to note that this "duration" value may vary from array to array and can vary from jet to jet or from patterning cycle to patterning cycle. This "duration" value is superimposed upon the "fire/don't fire" single-bit data received from the pattern data distribution operation and is temporarily stored in one or more shift registers individually associated with each array. After a predetermined delay to allow time for the shift registers to fill, the data is sent simultaneously to the respective valves associated with the diverting streams of air at each dye jet position along the array.

Figure 12:
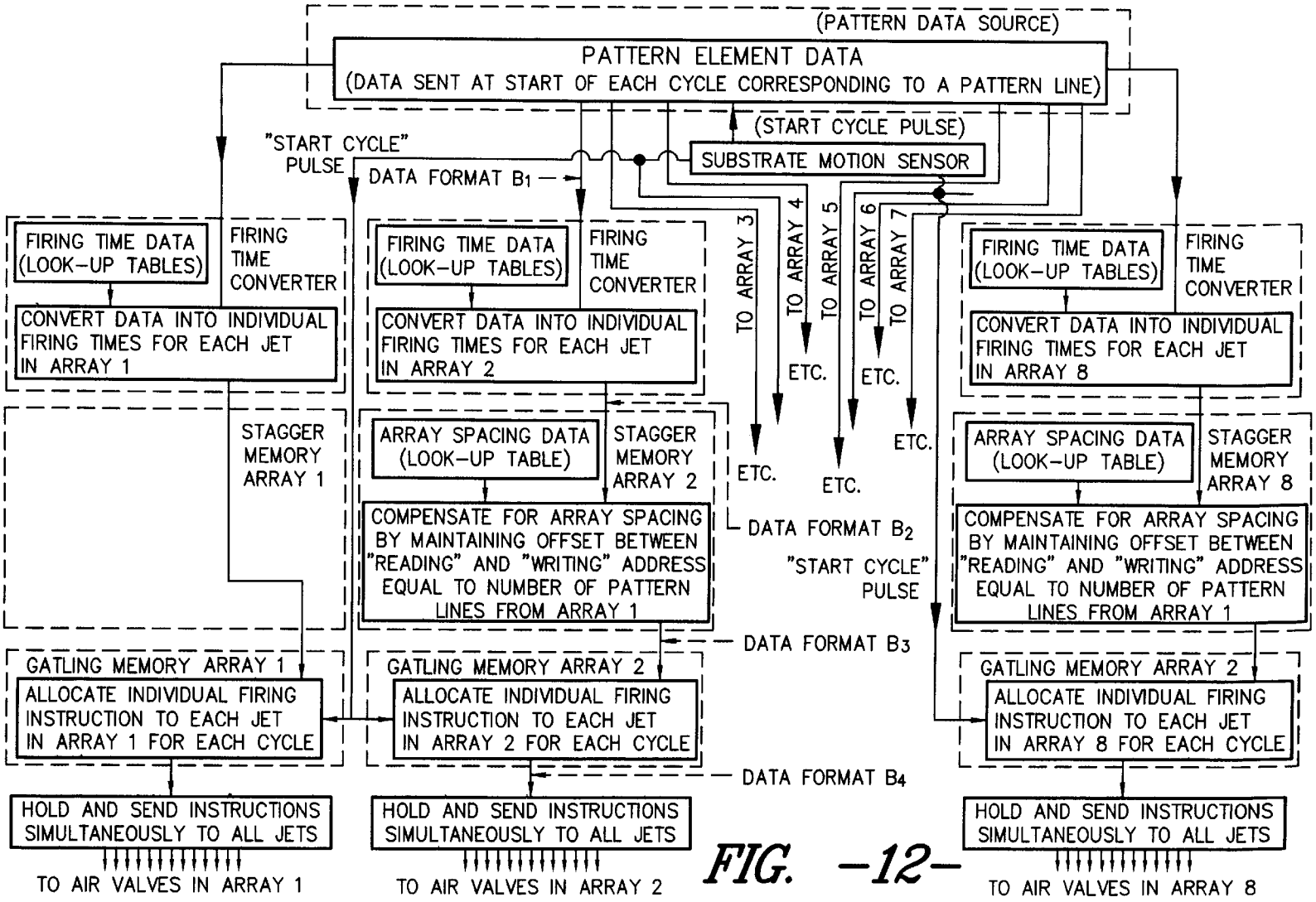
FIG. 12 is a block diagram disclosing, in overview, a prior art electronic control system that may be used in connection with the patterning device disclosed herein.
Figure 13A:
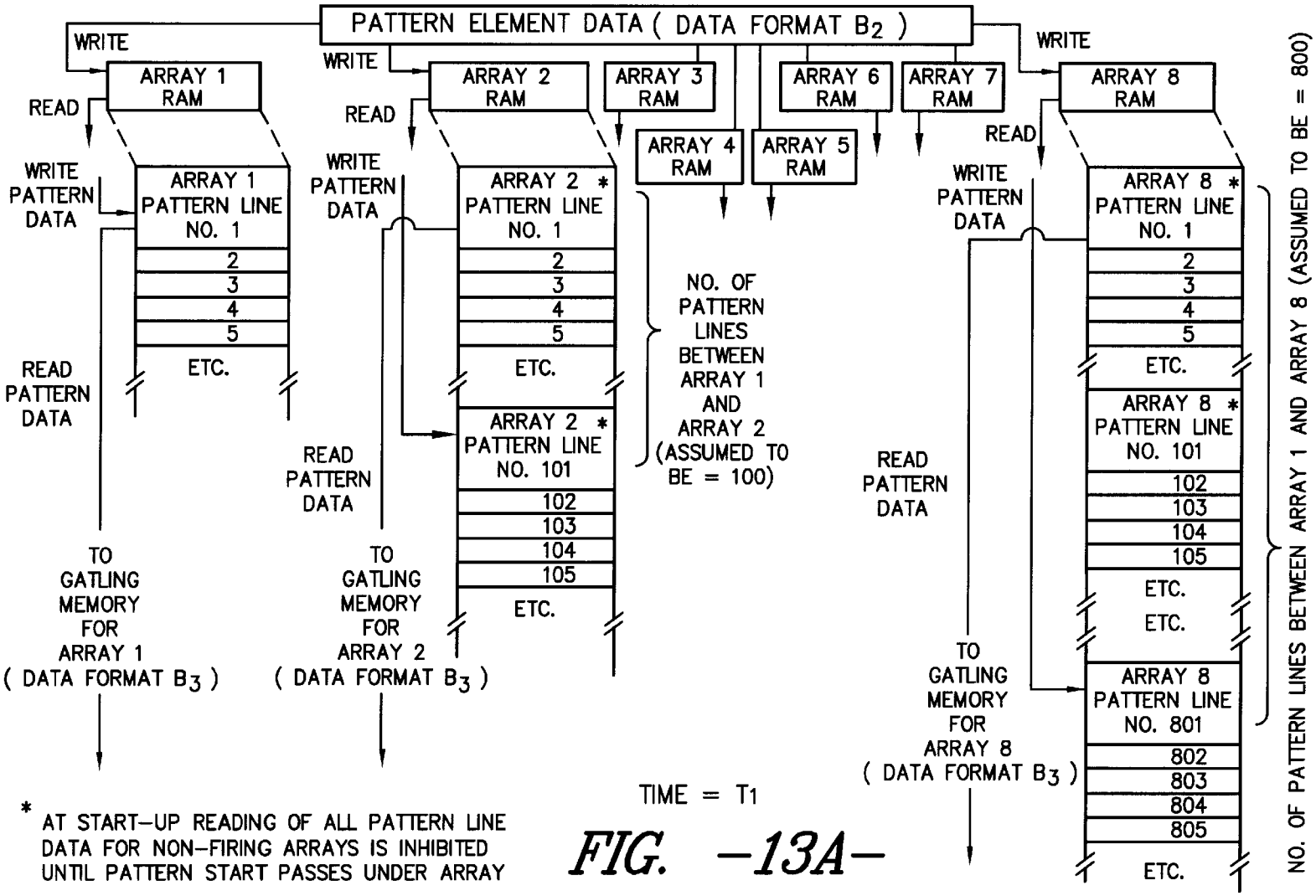
FIGS. 13A and 13B are diagrammatic representations of the prior art "stagger" memory disclosed in FIG. 12.
Figure 13B:
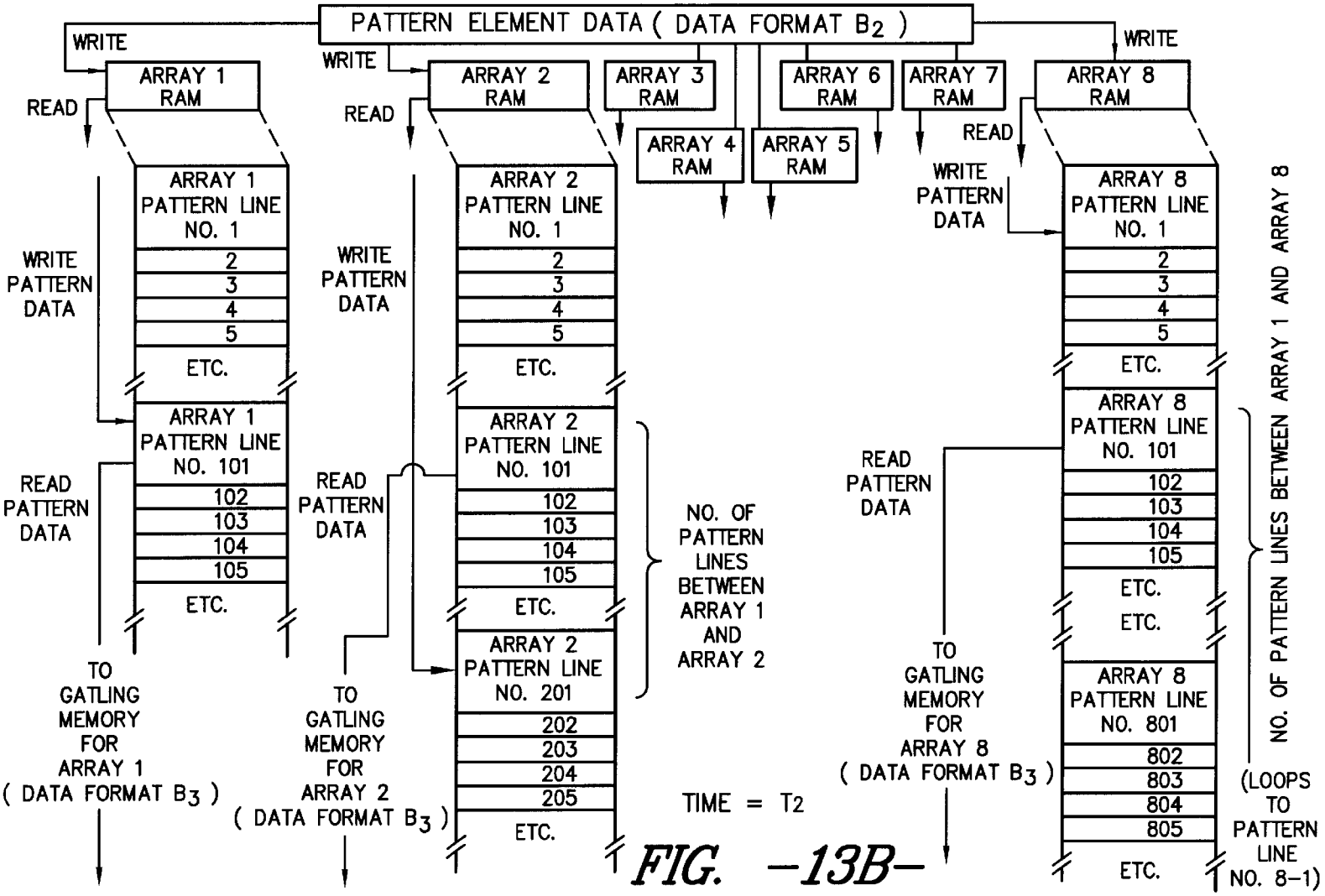
Figure 14:
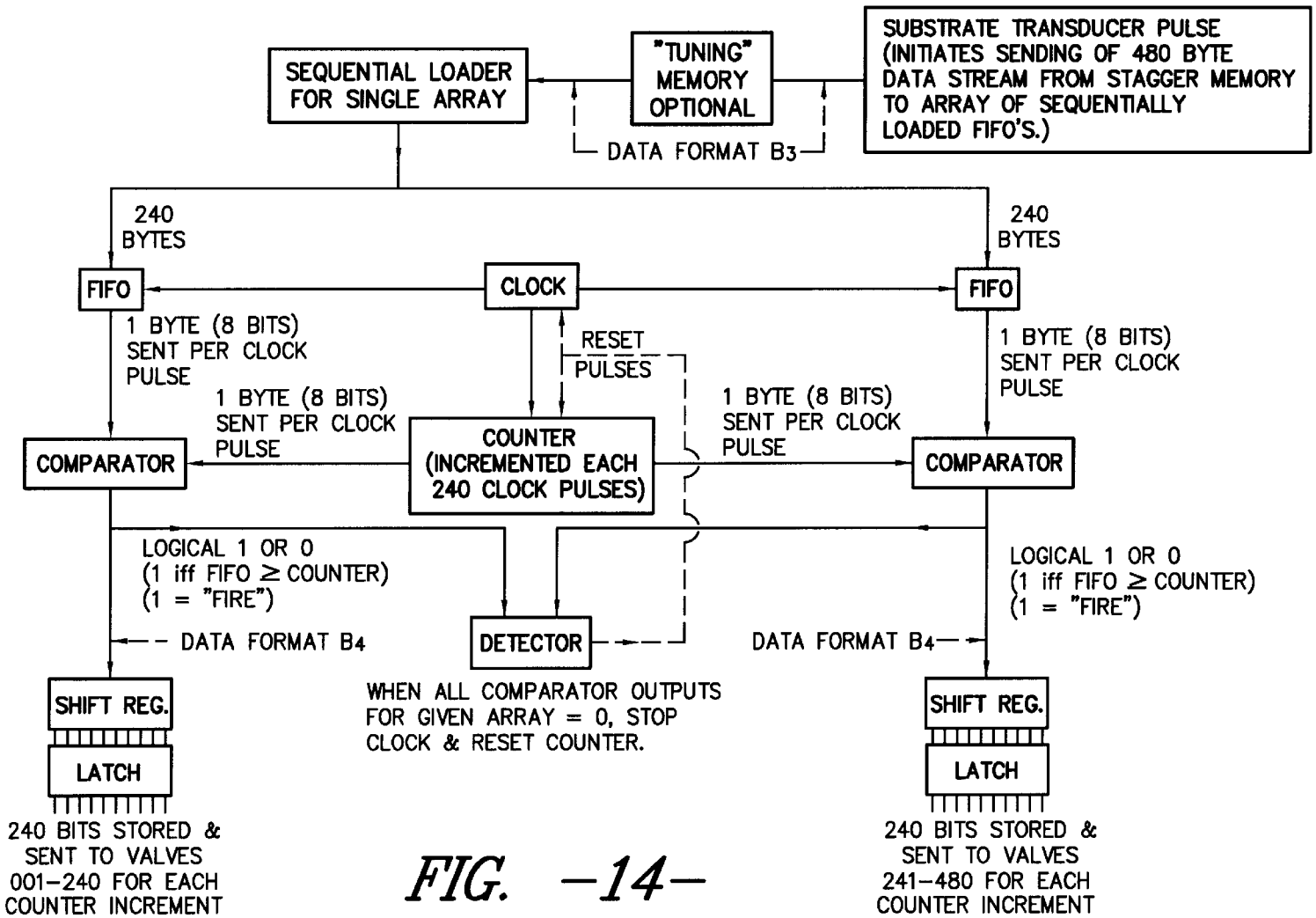
FIG. 14 is a block diagram describing the prior art "gatling" memory described in FIG. 12.
Figure 15:
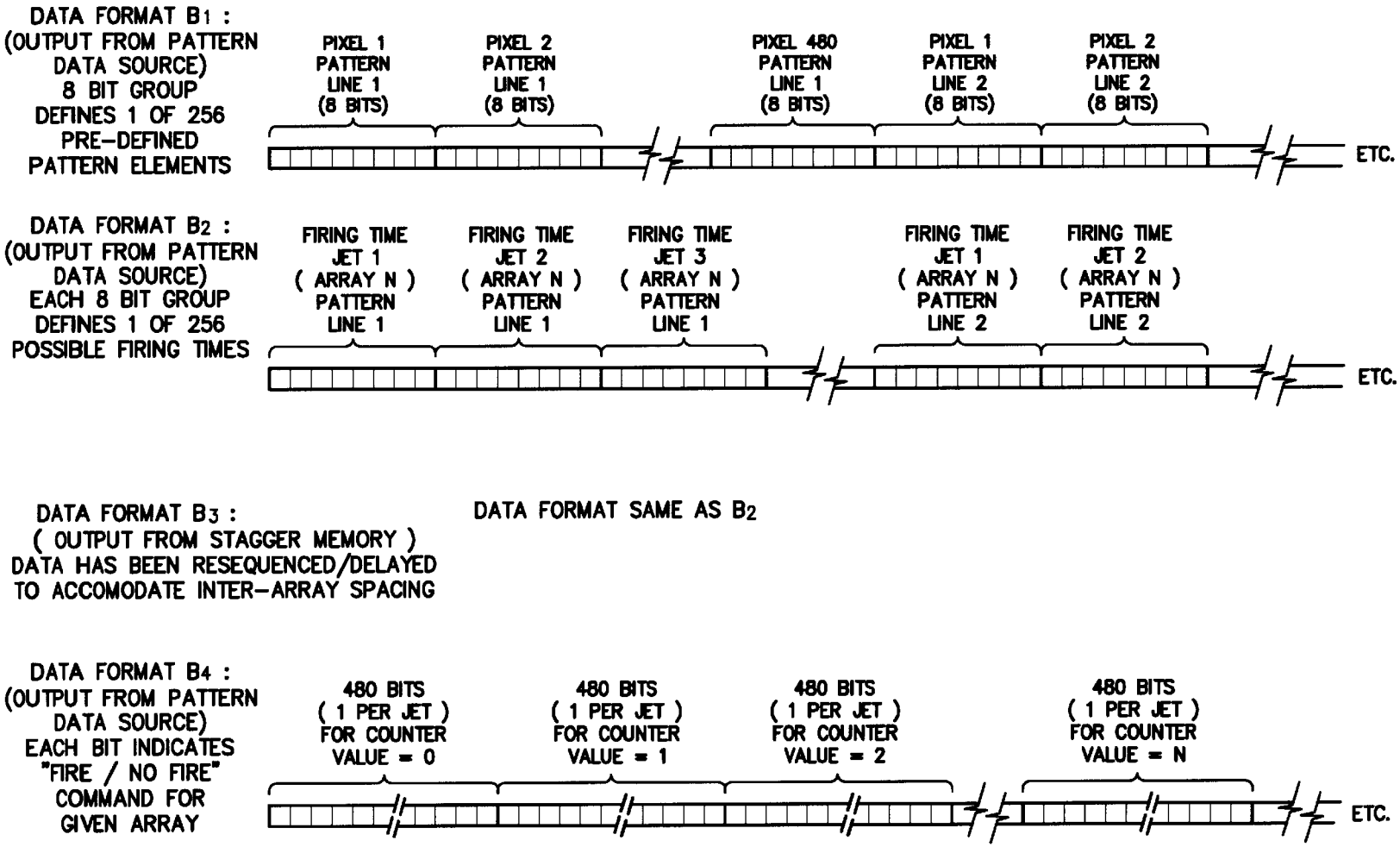
FIG. 15 schematically depicts the format of the pattern data at various prior art data processing stages as indicated in FIGS. 12 through 14.

The control system depicted in FIGS. 12 through 15 may be most easily described by considering the system as essentially comprising three separate data storage and allocation systems (a firing time converter, which incorporates a memory, a "stagger" memory and a "gatling" memory) operating in a serial sequence. These systems are schematically depicted in FIG. 12, which represents an overview of the control system of the present invention as applied to a patterning device disclosed above. FIG. 15 schematically depicts representative data formats at the process stages indicated in FIG. 12. Each array is associated with a respective firing time converter and "stagger" memory, followed by a separate "gatling" memory, arranged in tandem. Each of these major elements will be discussed in turn.

The raw pattern data is sent as prompted by the "start pattern cycle" pulse received from the substrate motion sensor (FIG. 12). This sensor merely generates a pulse each time the substrate conveyor moves the substrate a predetermined linear distance (e.g., one-tenth inch) along the path under the patterning arrays. (Note that, in the system of the prior art, the "start pattern cycle" pulse was received form the registration control system; in the novel system described herein, a separate registration control system is not needed.) The same "start pattern cycle" pulse is simultaneously sent to each array, for reasons which will be explained below.

The raw patterning data is in the form of a sequence of pixel codes, with one such code specifying, for each pattern line, the dye jet response for a given dye jet position on each and every array, i.e., each pixel code controls the response of eight separate dye jets (one per array) with respect to a single pattern line. As discussed above, the pixel codes merely define those distinct areas of the pattern which may be assigned a different color. The data is preferably arranged in strict sequence, with data for applicators 1–480 (assuming 480 applicators per color bar) for the first pattern line being first in the series, followed by data for applicators 1–480 for the second pattern line, etc., as depicted by Data Format B1 of FIG. 15.

The complete serial stream of such pixel codes is sent, in identical form and without any array-specific allocation, to a firing time converter/memory associated with each respective array for conversion of the pixel codes into firing times. This stream of pixel codes preferably comprises a sufficient number of codes to provide an individual code for each dye jet position across the substrate for each pattern line in the overall pattern. Assuming eight arrays of 480 applicators each, a pattern line of 0.1 inch in width (measured along the substrate path), and an overall pattern which is 60 inches in length (i.e., measured along the substrate path), this would require a raw pattern data stream comprised of 288,000 separate codes.

Comprising each firing time converter is a look-up table having a sufficient number of addresses so that each possible address code forming the serial stream of pattern data may be assigned a unique address in the look-up table. At each address within the look-up table is a byte representing a relative firing time or dye contact time, which, assuming an eight bit address code is used to form the raw pattern data, can be zero or one of 255 different discrete time values corresponding to the relative amount of time the dye jet in question is to remain "on." (More accurately, in the patterning apparatus disclosed, these time values represent the relative amount of time the valve associated with the respective diverting air jet shall remain closed, thereby interrupting the diverting air stream and allowing the stream of dye to strike the substrate.) Accordingly, for each eight-bit byte of pixel data, one of 256 different firing times (including a firing time of zero) is defined for each specific jet location on each and every array.

Jet identity is determined by the relative position of the address code within the serial stream of pattern data and by the information pre-loaded into the look-up table, which information specifies in which arrays a given jet position fires, and for what length of time. (If desirable, data individually comprised of two or more bytes, specifying, e.g., one of 65,536 different firing times or other patterning parameter levels may be used in accordance with the teachings herein, with appropriate modifications to the hardware.) The result is sent, in Data Format B2 (see FIG. 15), to the "stagger" memory associated with the given array. AT this point, no attempt has been made to compensate for the physical spacing between arrays or to group and hold the date for sending to the actual air valves associated with each dye jet.

Compensation for the physical spacing between arrays may be best explained with reference to FIGS. 13A and 13B, which functionally describe the individual stagger memories for various arrays in greater detail.

The "stagger" memory operates on the firing time data produced by the look-up tables and performs two principal functions: (1) the serial data stream from the look-up table, representing firing times, is grouped and allocated to the appropriate arrays on the patterning machine and (2) "non-operative" data is added to the respective pattern data for each array to inhibit, at start-up and for a pre-determined interval which is specific to that particular array, the reading of the pattern data in order to compensate for the elapsed time during which the specific portion of the substrate to be patterned with that pattern data is moving from array to array.

The "stagger" memory operates as follows. The firing time data is sent to an individual random access memory (RAM) associated with each of the eight arrays. Although either static or dynamic RAMs may be used, static RAMs have been found to be preferred because of increased speed. At each array, the data is written to the RAM in the order in which it was sent from the look-up table, thereby preserving the jet and array identity of the individual firing times. Each RAM preferably has sufficient capacity to hold firing time information for the total number of pattern lines extending from the first to the eighth array (assumed to be seven hundred for purposes of discussion) for each jet in its respective array. In the discussion which follows, it may be helpful to consider the seven hundred pattern lines as being arranged in seven groups of one hundred pattern lines each (to correspond with the assumed inter-array spacing).

The RAMs are both written to and read from in a unidirectional repeating cycle, with all "read" pointer being collectively initialized and "lock-stepped" so that corresponding address locations in all RAMs for all arrays are read simultaneously. Associated with each RAM is a predetermined offset value which represents the number of sequential memory address values separating the "write" pointer used to insert the data into the memory addresses and the "read" pointer used to read the data from the RAM addresses, thereby "staggering" in time the respective read and write operations for a given memory address.

As depicted on the left hand side of FIG. 13A, the RAM offset value for the first array is zero, i.e., the "read pattern data" operation is initiated at the same memory address as the "write pattern data" operation, with no offset. The offset for the second array, however, is shown as being one hundred, which number is equal to the number of pattern lines or pattern cycles (as well as the corresponding number of read or write cycles) needed to span the distance physically separating the first array from the second array, as measured along the path of the substrate in units of pattern lines.

As depicted, the "read pattern" pointer, initialized at the first memory address location, is found one hundred address locations "above" or "earlier" than the "write" pointer. Accordingly, beginning the "read" operation at a memory address location which lags the "write" operation by one hundred consecutive locations effectively delays the reading of the written data by one hundred pattern cycles to correspond to—and compensate for—the physical spacing between the firs and second array. To avoid using "dummy" data for the "read" operation until the "read" pointer catches up with the first address written to by the "write" pointer, a "read inhibit" procedure may be used. Such procedure would only be necessary at the beginning and end of a pattern. Alternatively, data representing zero firing time can be loaded into the RAMs in the appropriate address locations so that the "read" operation, although enabled, reads data which disables the jets during such times.

The right hand side of FIGS. 13A and 13B depicts the stagger memory for the eighth array. As with all other arrays, the "read" pointer has been initialized to the first memory address in the RAM. The "write" pointer, shown at its initialized memory address location, leads the "read" pointer by an address difference equivalent to seven hundred pattern lines (assuming seven intervening arrays and a uniform inter-array spacing of one hundred pattern lines).

FIG. 13B depicts the stagger memories of FIG. 13A exactly one hundred pattern cycles later, i.e., after the data for one hundred pattern lines have been read. The "read" and "write" pointer associated with Array 1 are still together, but have moved "down" one hundred memory address locations and are now reading and writing the firing time data associated with the first line of the second group of one hundred pattern lines in the RAM.

The "read" and "write" pointers associated with Array 2 are still separated by an offset corresponding to the physical spacing between Array 1 and Array 2, as measured in units of pattern lines. Looking at the pointers associated with Array 8, the "read" pointer is positioned to read the first line of firing time data from the second group of one hundred pattern lines, while the "write" pointer is positioned to write new firing time data into RAM addresses which will be read only after the existing seven hundred pattern lines in the RAM are read. It is therefore apparent the "read" pointer is specifying firing time data which was written seven hundred pattern cycles previously.

The storage registers associated with each array's stagger memory store the firing time data for the pattern line to be dyed by that respective array in that pattern cycle until prompted by a pulse from the substrate transducer indicating the substrate has traveled a distance equal to the width of one pattern line. At that time, the firing time data, in Data Format B3 (see FIG. 15), is sent to the "gatling" memory for processing as indicated below, and firing time data for the next pattern line is forwarded to the stagger memory for processing as described above.

FIG. 14 depicts a "gatling" memory module for one array. For the patterning device depicted in FIG. 1, eight configurations of the type shown in FIG. 14 would be necessary, one for each array. In a preferred embodiment, all would be driven by a common clock and counter. The gatling memory performs two principal functions: (1) the serial stream of encoded firing times is converted to individual strings of logical (i.e., "on" or "off") firing commands, the length of each respective "on" string reflecting the value of the corresponding encoded firing time, and (2) these commands are quickly and efficiently allocated to the appropriate applicators.

As depicted in FIG. 14, associated with each array is a set of dedicated first in-first out memory modules (each of which will be hereinafter referred to as a "FIFO"). An essential characteristic of the FIFO is that data is read out of the FIFO in precisely the same order or sequence in which the data was written into the FIFO. In the exemplary embodiment described herein, the set of FIFO modules must have a collective capacity sufficient to store one byte (i.e., eight bits, equal to the size of the address codes comprising the original pattern data) of data for each of the four hundred eighty diverting air valves in the array. For purposes of explanation, it will be assumed that each of the two FIFOs shown can accommodate two hundred forty bytes of data.

Each FIFO has its input connected to the sequential loader and its output connected to an individual comparator. A counter is configured to send an eight bit incrementing count to each of the comparators in response to a pulse from a "gatling" clock. The "gatling" clock is also connected to each FIFO, and can thus synchronize the initiation of operations involving both the FIFOs and the respective comparators associated with each FIFO. If the smallest increment of time on which "firing time" is based is to be different from array to array, independent clocks and counters may be associated with each such array. Preferably, the output from each comparator may be operably connected to a respective shift register/latch combination, which serves to store temporarily the comparator output data before it is sent to the respective array, as described in more detail below. Each comparator output is also directed to a common detector, the function of which shall be discussed below. As indicated in FIG. 14, a reset pulse from the detector is sent to both the "gatling" clock and the counter at the conclusion of each pattern cycle, as will be explained below.

In response to the transducer pulse, the respective stagger memories for each array are read in sequence and the data is fed to an array-specific sequential loader, as depicted in FIG. 14. The sequential loader sends the first group of two hundred forty bytes of data received to a first FIFO and the second group of two hundred forty byes of data to a second FIFO. Similar operations are performed simultaneously at other sequential loaders associated with other arrays. Each byte represents a relative firing time or dye contact time (or, more accurately, an elapsed diverting air stream interruption time) for an individual jet in the array.

After each of the FIFOs for each array are loaded, they are simultaneously sent a series of pulses from the "gatling" clock, each pulse prompting each FIFO to send a byte of data (comprised in eight bits), in the same sequence in which the bytes were sent to the FIFO by the sequential loader, to its respective individual comparator. This FIFO "firing time" data byte is one of two separate inputs received by the comparator, the second input being a byte sent from a single counter common to all FIFOs associated with every array. This common counter byte is sent in response to the same gatling clock pulse which prompted the FIFO data, and serves as a clock for measuring elapsed time from the onset of the dye stream striking the substrate for this pattern cycle. At each pulse from the gatling clock, a new byte of data is released from each FIFO and sent to its respective comparator.

At each comparator, the eight bit "elapsed time" counter value is compared with the value of the eight bit "firing time" byte sent by the FIFO. The result of this comparison is a single "fire/no fire command" bit sent to the shift register as well as the director. If the FIFO value is greater than the counter value, indicating the desired firing time as specified by the pattern data is greater than the elapsed firing time as specified by the counter, the comparator output bit is a logical "one" (interpreted by the array applicators as a "fire" command). Otherwise, the comparator output bit is a logical "zero" (interpreted by the array applicators as a "no fire" or "cease fire" command). At the next gatling clock pulse, the next byte of firing time data in each FIFO (corresponding to the next individual jet along the array) is sent to the respective comparator, where it is compared with the same counter value. Each comparator compares the value of the firing time data forwarded by its respective FIFO to the value of the counter and generates a "fire/no fire" command in the form of a logical one or logical zero, as appropriate, for transmission to the shift register and the detector.

This process is repeated until all two hundred forty "firing time" bytes have been read from the FIFOs and have been compared with the "elapsed firing time" value indicated by the counter. At this time the shift register, which now contains a serial string of two hundred forty logical ones and zeros corresponding to individual firing commands, forwards these firing commands in parallel format to a latch. The latch serves to transfer, in parallel, the firing commands from the shift register to the individual air valves associated with the array dye applicators at the same time the shift register accepts a fresh set of two hundred forty firing commands for subsequent forwarding to the latch. Each time the shift register forwards its contents to the latch (in response to a clock pulse), the counter value is incremented.

Following this transfer, the counter value is incremented by one time unit and the process is repeated, with all two hundred forty bytes of "firing time" data in each FIFO being reexamined and transformed into two hundred forty single bit "fire/no fire" commands, in sequence, by the comparator using the newly incremented value of "elapsed time" supplied by the counter. While, in a preferred embodiment, the serial firing commands may be converted to, and stored in, a parallel format by the shift register/latch combination disclosed herein, it is foreseen that various alternative techniques for directing the serial stream of firing commands to the appropriate applicators may be employed, perhaps without converting said commands to a true parallel format.

The above process, involving the sequential comparison of each FIFO's entire capacity of firing time data with each incremented "elapsed time" value generated by the counter, is repeated until the detector determines that all comparator outputs for that array are a logical "zero." This indicates that, for all jets in the array, no desired firing time (represented by the FIFO values) for any jet in the array exceeds the elapsed time indicated by the counter. When this condition is sensed by the comparator, it indicates that, for that pattern line and that array, all required patterning has occurred. Accordingly, the detector sends "reset" pulses to both the counter and to the gatling clock. The gatling module then waits for the next substrate transducer pulse to prompt the transmission and loading of firing time data for the next pattern line by the sequential loader into the FIFOs, and the reiterative reading/comparing process is repeated as described above.

In a preferred embodiment, the gatling memory for each array may actually consist of two separate and identical FIFOs which may alternately be connected to the array valves. In this way, while data are being read out and compared in one gatling memory, the data for the next pattern line may be loaded into the FIFOs associated with the alternate gatling memory, thereby eliminating any data loading delays which might otherwise be present if only one gatling memory per array were used. It should be apparent that the number of individual FIFOs may be appropriately modified to accommodate a grater or lesser number of dye jets in an array.

Figure 16:
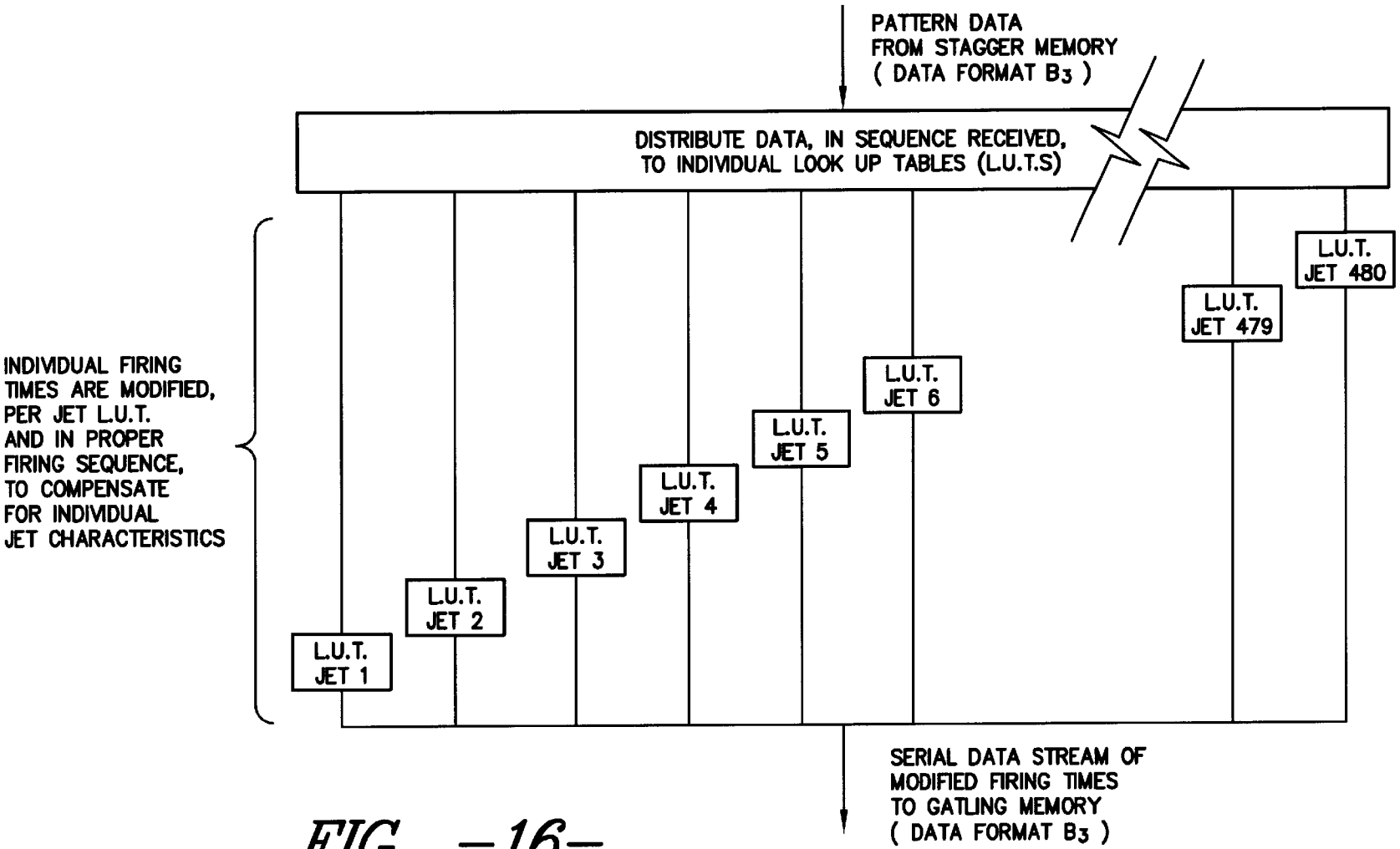
FIG. 16 is a diagram showing an optional prior art "jet tuning" function which may be associated with each array, as described herein.

FIG. 16 depicts an optional memory, to be associated with each array, which may be used when maximum pattern definition is desired. This memory, which may take the form of a static RAM, functions in a "tuning" or "trimming" capacity to compensate, in precise fashion, for small variations in the response time or dye flow characteristics of the individual applicators. This is achieved by means of a look-up table embodied in the RAM which associates, for each applicator in a given array, and, if desired, for each possible firing time associated with each such applicator, an individual factor which increases or decreases the firing time dictated by the pattern data by an amount necessary to cause all applicators in a given array to deliver substantially the same quantity of dye onto the substrate in response to the same pattern data firing instructions.

The preferred embodiments described above are intended to be by way of example only. It is anticipated that modifications to the above that fall within the scope of the present invention will be apparent from the above description. The present invention is to be limited not by that description, but rather by the scope of the following claims.

I claim:

1. A process for generating, in pixel-wise fashion on a desired absorbent substrate, a reproduction of a desired pattern comprised of a plurality of target colors, said reproduction being formed by the pixel-wise application of a limited number of individual liquid coloring agents to said substrate, each agent having a color that may be distinct from any of said target colors, said process comprising the steps of:

a. determining values for selected physical characteristics of said absorbent substrate that determine color reflectivity;

b. determining the color component values of each of said individual liquid coloring agents on said substrate;

c. generating the relative concentration values of all appropriate blends of said individual liquid coloring agents formed by the application of a plurality of different liquid coloring agents to the same pixel on said substrate;

d. mathematically predicting and generating a comprehensive color palette comprised of color component values of all of said individual liquid coloring agents and all appropriate blends of said liquid coloring agents, as said agents and said blends of agents would appear on a substrate having said selected physical characteristic values of said absorbent substrate;

e. determining the color component values of said target colors;

f. comparing the color component values of said target colors with the color component values of said comprehensive color palette; and g. at the location of each pixel in said reproduction, selecting from said palette a color that, when said pixel is viewed together with adjoining pixels in said reproduction at a distance at which individual pixels are unresolved by the eye, will visually approximate the target color associated with a corresponding pixel location in said desired pattern when said desired pattern is viewed at a distance at which individual pixels are unresolved by the eye.

2. The process of claim 1 wherein the collective concentration of said plurality of different liquid coloring agents within each pixel in said reproduction is about 100%.

3. The process of claim 2 wherein the collective concentration of said plurality of different liquid coloring agents is less than 100%.

4. The process of claim 1 wherein said physical characteristics of said substrate includes a substrate color, and wherein said substrate color is included in Step (d) as a separate, additional color in said comprehensive color palette.

5. The Process of claim 1 wherein said physical characteristics of said substrate includes a substrate color, and wherein the color component values of said substrate color are determined and included as part of Steps (a) and (b) to determine the color component values of all available liquid coloring agents and all appropriate blends of said liquid coloring agents, as such agents and blends of agents would appear when combined with said color of said absorbent substrate.

6. The process of claim 1 wherein the generation of the color palette of Step (d) includes an accommodation for the effects of reflectance on the color of liquid coloring agents applied to absorbent substrates.

7. The process of claim 6 wherein said accommodation involves the use of the Kubelka-Munk k over s relationship.

8. The process of claim 6 wherein said selected physical characteristics of said substrate includes wicking characteristics.

9. The process of claim 6 wherein said selected physical characteristics of said substrate includes density characteristics.

10. The process of claim 1 wherein said selection of color in Step (g) is achieved with the aid of a computer-based dithering algorithm.

11. A process for patterning a textile substrate with a designated electronically-defined, multi-colored pattern by the selective, pixel-wise application of colorants to a selected substrate by electronically actuated colorant applicators, said designated pattern containing different colors than the colors of said colorants, said method comprising the steps of:

a. selecting the colors of colorants to be available for application to said substrate;

b. determining physical characteristics of the selected substrate that influence the appearance of colorants applied to the substrate;

c. determining the color values of said selected colorants, as they appear on the selected substrate;

d. determining the colors of all appropriate blends of said colorants formed by the application of a plurality of different liquid coloring agents to the same pixel on said substrate;

e. for each of said appropriate blends of colorants, determining the color values of such blends as they appear on said substrate;

f. determining the color values of each color in the designated pattern;

g. predicting and generating, in electronic form, a color palette consisting of the colors of said selected colorants and all of said appropriate blends of said colorants, as each will appear on said substrate having said physical characteristics;

h. generating, in electronic form, a pixel-wise dithered image of the designated pattern using the colors of said color palette that most closely reproduces the colors in the designated pattern;

i. generating, on a pixel-by-pixel basis, an electronic signal carrying instructions to each colorant applicator to apply a specified aliquot of one or more colorants to the substrate to form on the substrate the dithered image of Step (h); and j. transmitting said signal to said dye applicators.

12. The process of claim 11 wherein said selected physical characteristics of said substrate are quantified and incorporated into the determination of the color values of said colorants and appropriate blends as recited in each of Steps (c) through (e), thereby providing a color palette in which said color values more closely represent those respective colorants and blends as they would appear on said substrate.

13. The process of claim 12 wherein one of said selected physical characteristics that are quantified and included in the determination of said color values is substrate reflectivity.

14. The process of claim 13 wherein said quantification of substrate reflectivity involves use of the Kubelka-Munk relationship.

15. The process of claim 14 wherein said selected physical characteristics include wicking characteristics.

16. The process of claim 14 wherein said selected physical characteristics include density characteristics.

17. The process of claim 12 wherein said physical characteristics of said substrate includes the color of the substrate prior to the application of any of said colorants, and wherein the color values of said substrate color are made a part of the color palette of Step (g).

18. The process of claim 11 wherein the color component values of said substrate color are used in Steps (c) through (e) to determine the color component values of all available liquid coloring agents and all appropriate blends of said liquid coloring agents, thereby providing a color palette in which said color values more closely represent those respective colorants and blends as they would appear on said substrate.

19. The process of claim 12 wherein said physical characteristics of said substrate include reflectivity characteristics, and wherein said reflectivity characteristics are used in Steps (c) through (e) to determine the color component values of all available liquid coloring agents and all appropriate blends of said liquid coloring agents, thereby providing a color palette in which said color values more closely represent those respective colorants and blends as they would appear on said substrate.

* * * * *